US006856299B1

(12) United States Patent
Seibert

(10) Patent No.: US 6,856,299 B1
(45) Date of Patent: Feb. 15, 2005

(54) HORIZONTAL POLARIZED BI-DIRECTIONAL FM STEREO ANTENNA

(76) Inventor: Jack Seibert, 828 Roosevelt Ave., Redwood City, CA (US) 94061-1512

( * ) Notice: Subject to any disclaimer, the term of this patent is extended or adjusted under 35 U.S.C. 154(b) by 37 days.

(21) Appl. No.: 10/351,720

(22) Filed: Jan. 27, 2003

(51) Int. Cl.[7] ..... H01Q 9/16

(52) U.S. Cl. ..... 343/822; 343/722; 343/819; 343/745

(58) Field of Search ..... 343/722, 745, 343/810, 819, 822, 823, 850, 818

(56) References Cited

U.S. PATENT DOCUMENTS 2,949,607 A * 8/1960 Lamb ..... 343/722
2,976,532 A * 3/1961 Guest ..... 343/722
5,424,751 A * 6/1995 Collier ..... 343/747

* cited by examiner

*Primary Examiner*—Shih-Chao Chen
(74) *Attorney, Agent, or Firm*—Sawyer Law Group LLP

(57) ABSTRACT

A frequency modulation antenna includes: a hermetically sealed driver assembly, which includes a driver tube, a gamma tube, a spacer stamping between the driver tube and the gamma tube, and an impedance matching block assembly between the driver tube and the gamma tube. The antenna eliminates conventional sources of signal degradation and interference due to its bi-directional nature, the hermetic sealing of the driver assembly, the coupling methods that prevent corrosion, and the dielectric coating. The antenna is further mounted to provide strength against the elements, facilitated by the precise mating of the driver assembly, the impedance matching block assembly, and a cleat to the mounting block, and the engagement of the teeth of the cleat and the serrations of a U-bolt to a pole. The antenna is significantly smaller than many conventional antennae while still being able to receive signals of low power without undue degradation or interference.

18 Claims, 25 Drawing Sheets

Driver Assembly

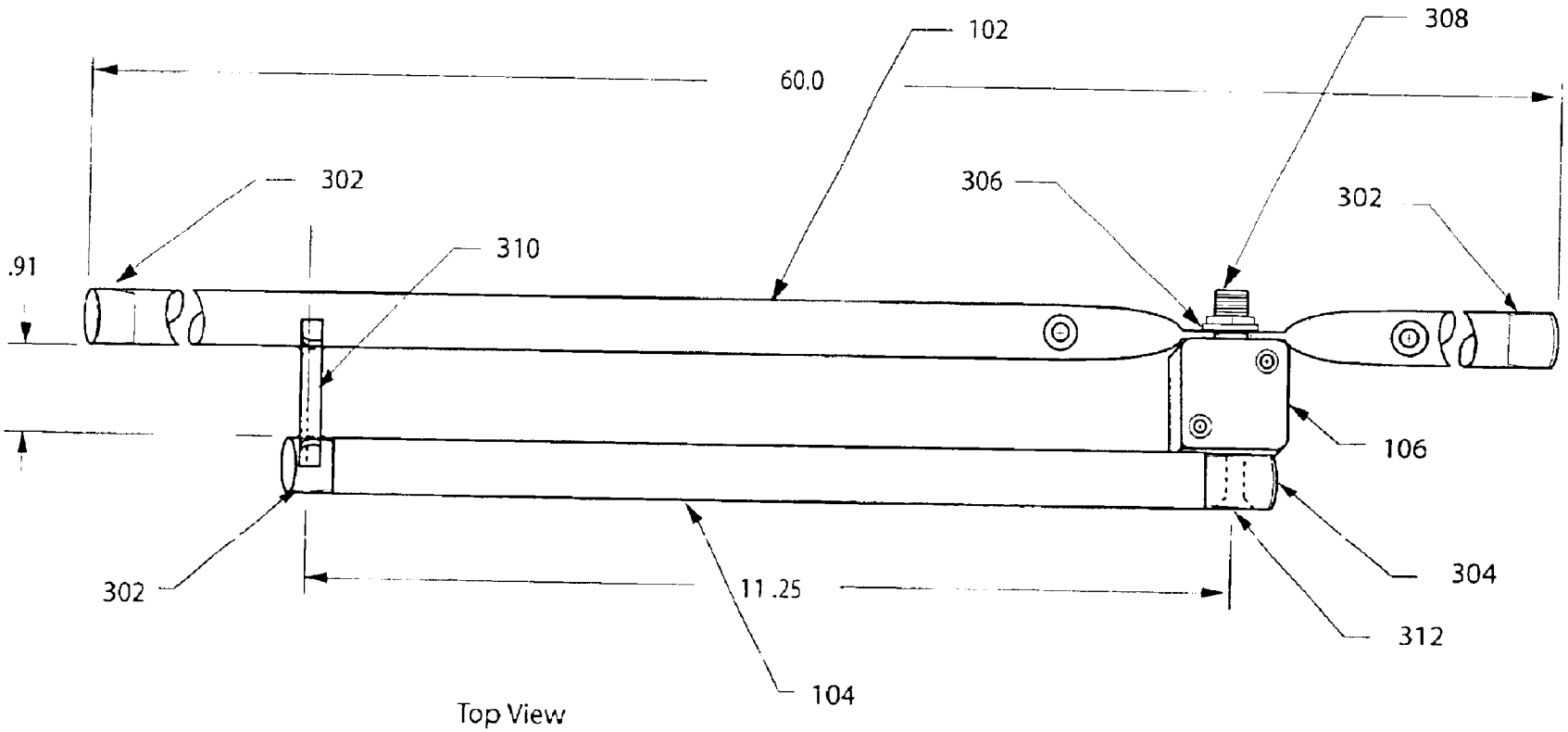
FIG. 3 Driver Assembly

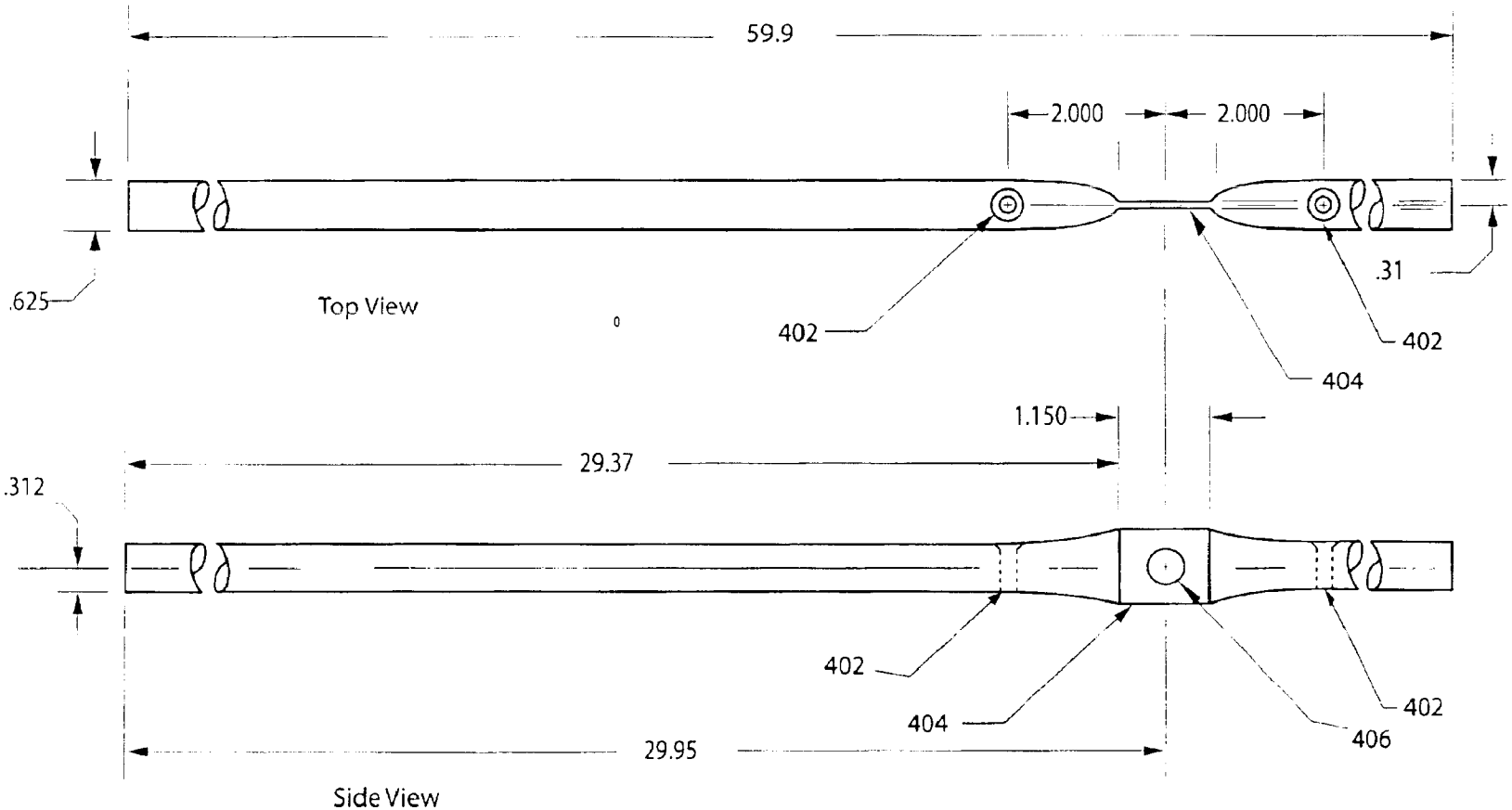
FIG. 4 Driver Tube

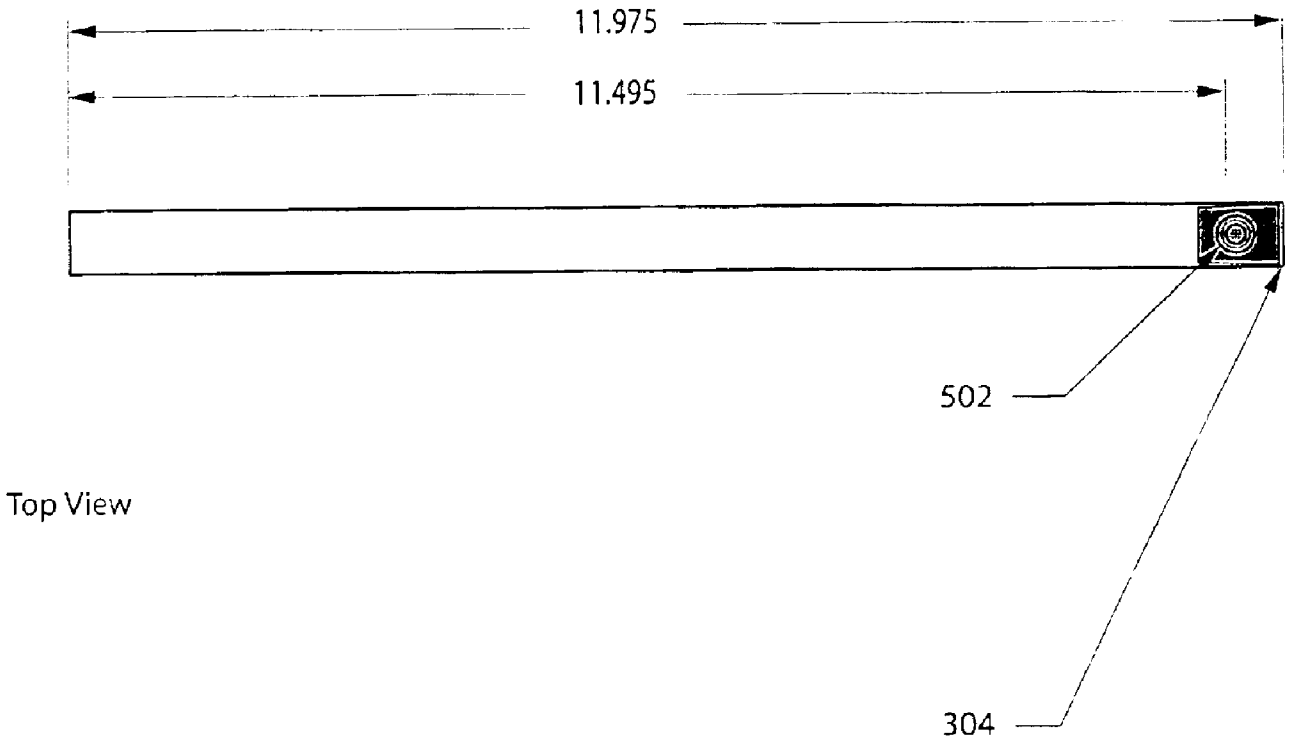
FIG. 5 Gamma Tube Assembly

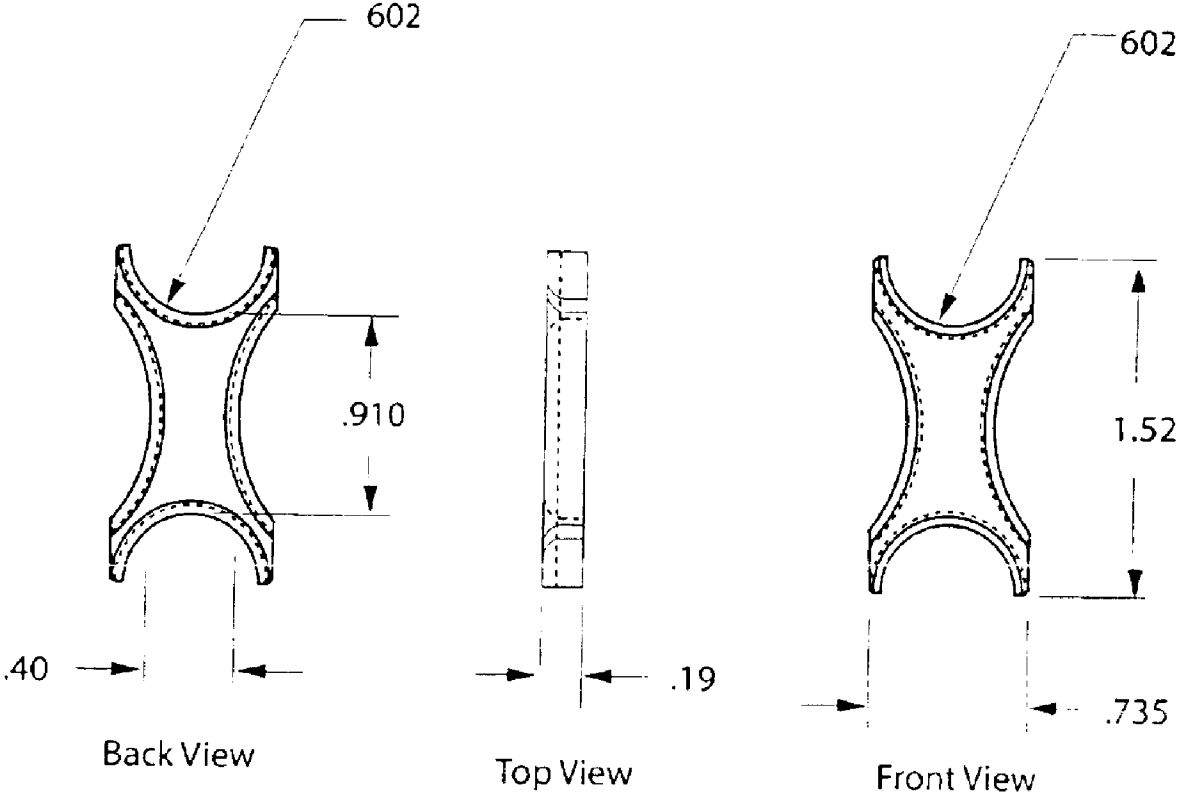
FIG. 6B Spacer Stamping

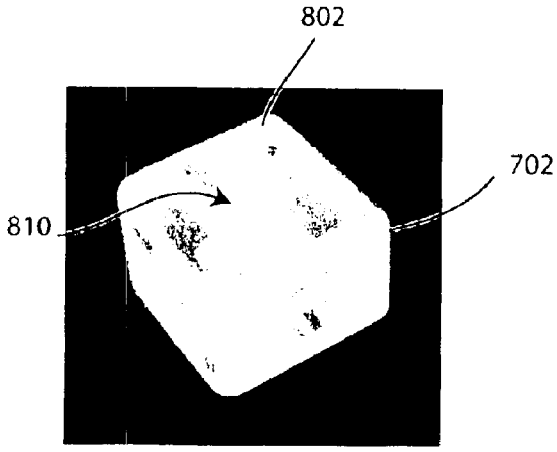
Front View
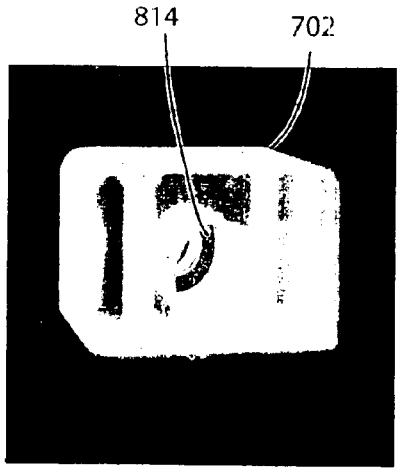
Back View
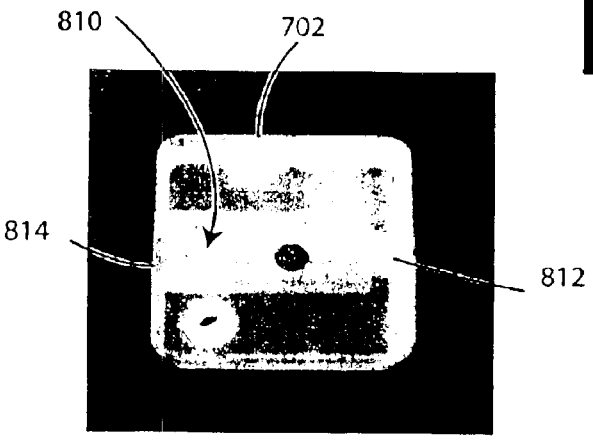
Top View
FIG. 8A

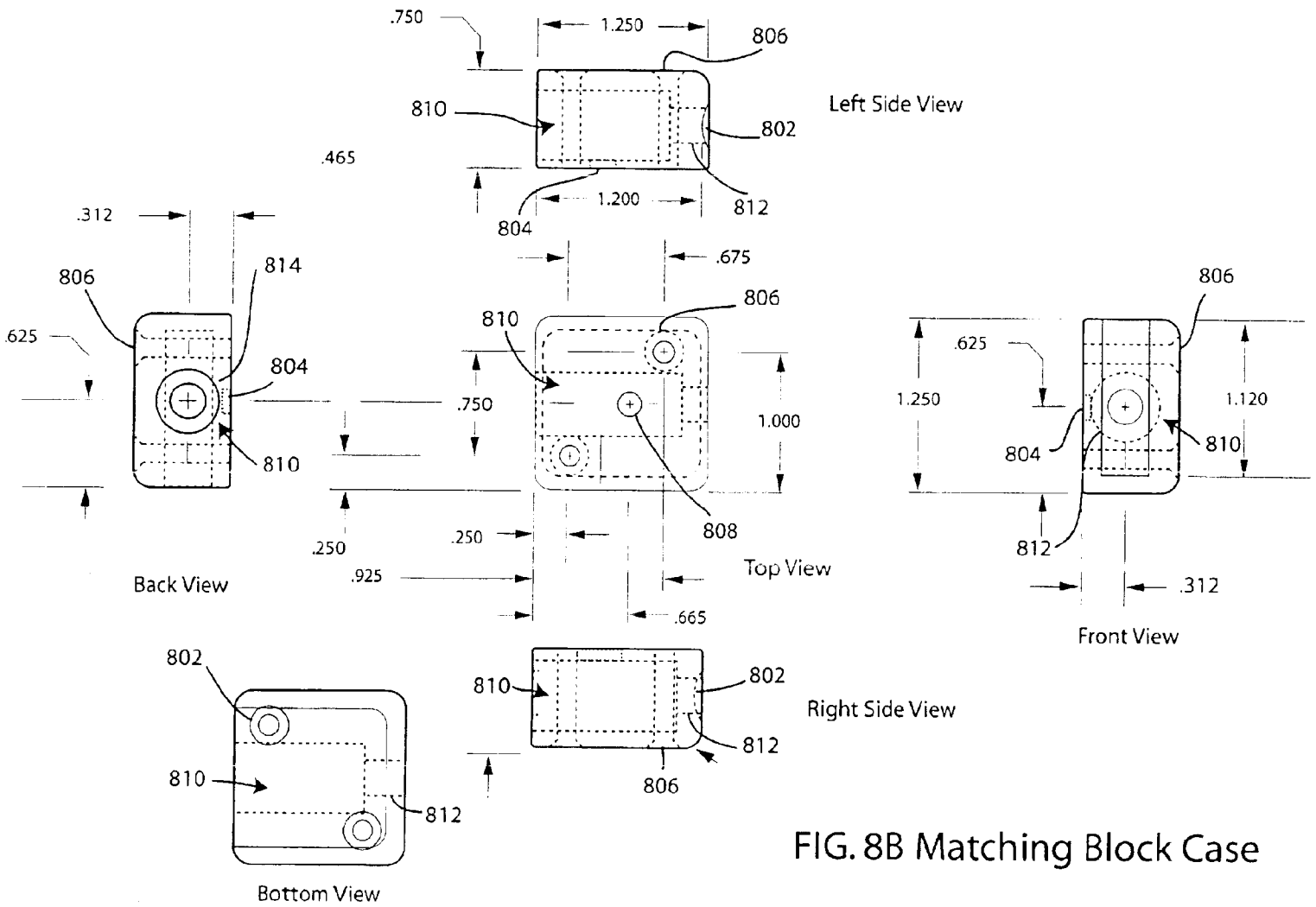
FIG. 8B Matching Block Case

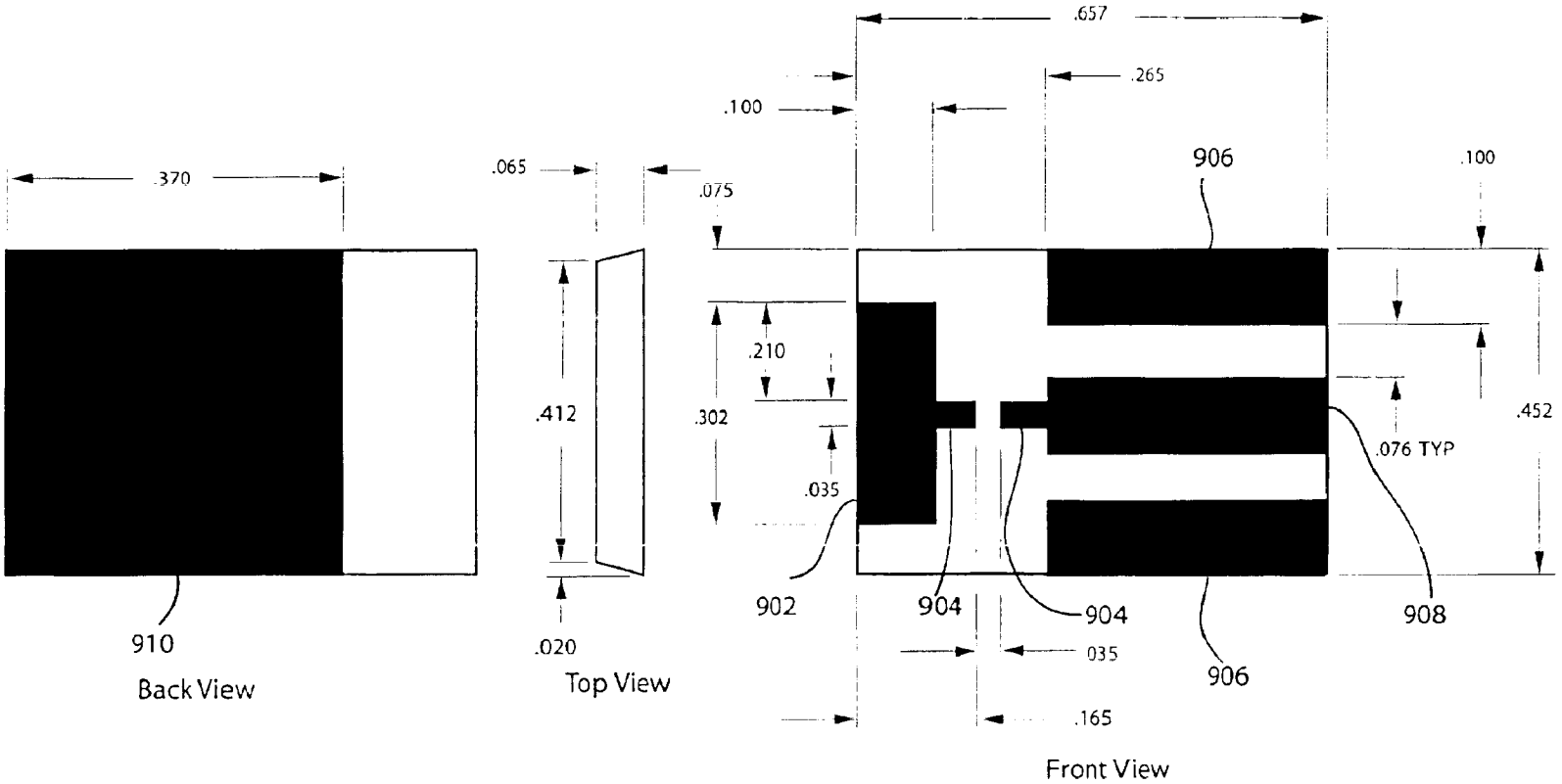
FIG. 9 Printed Circuit Board

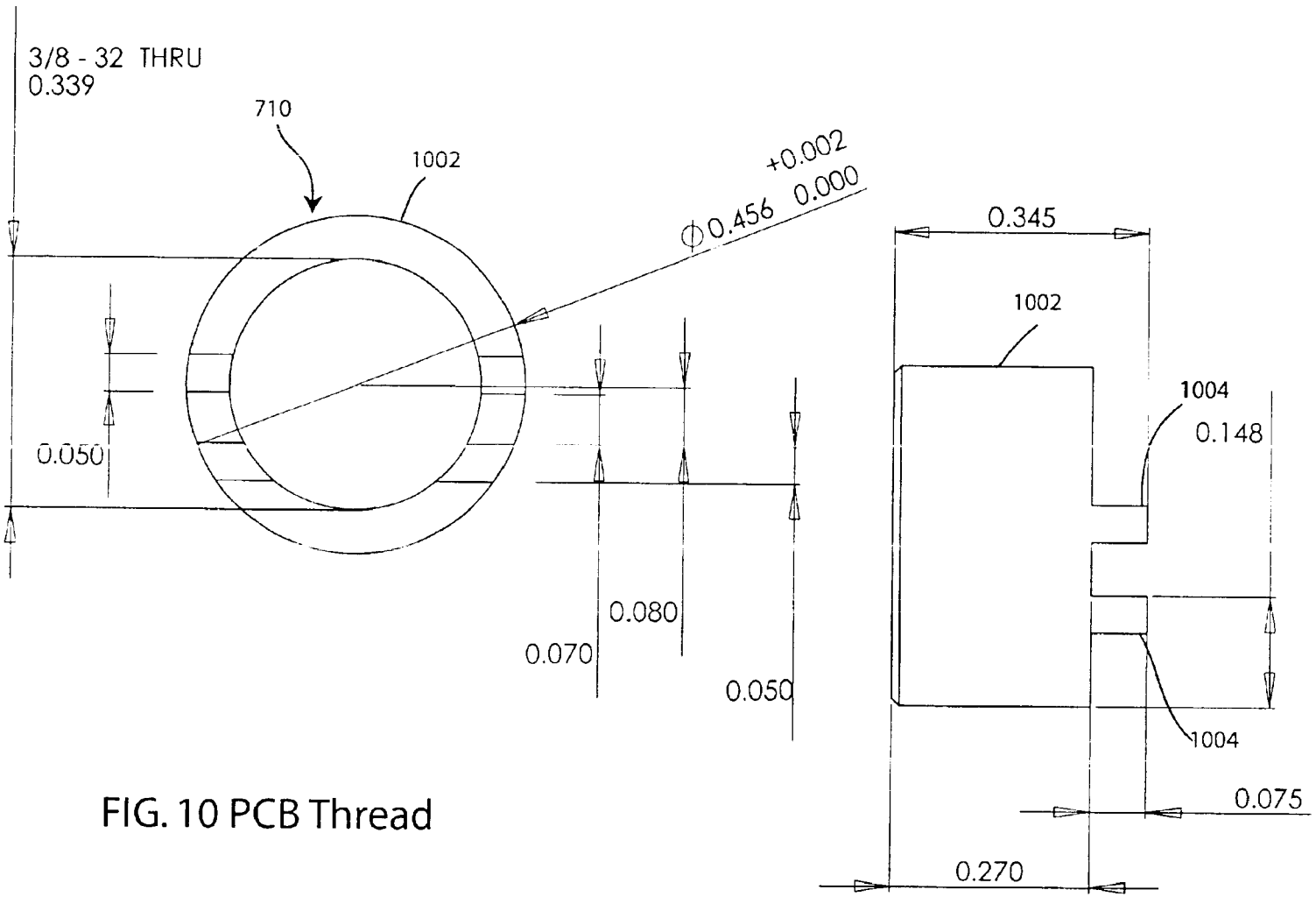
FIG. 10 PCB Thread

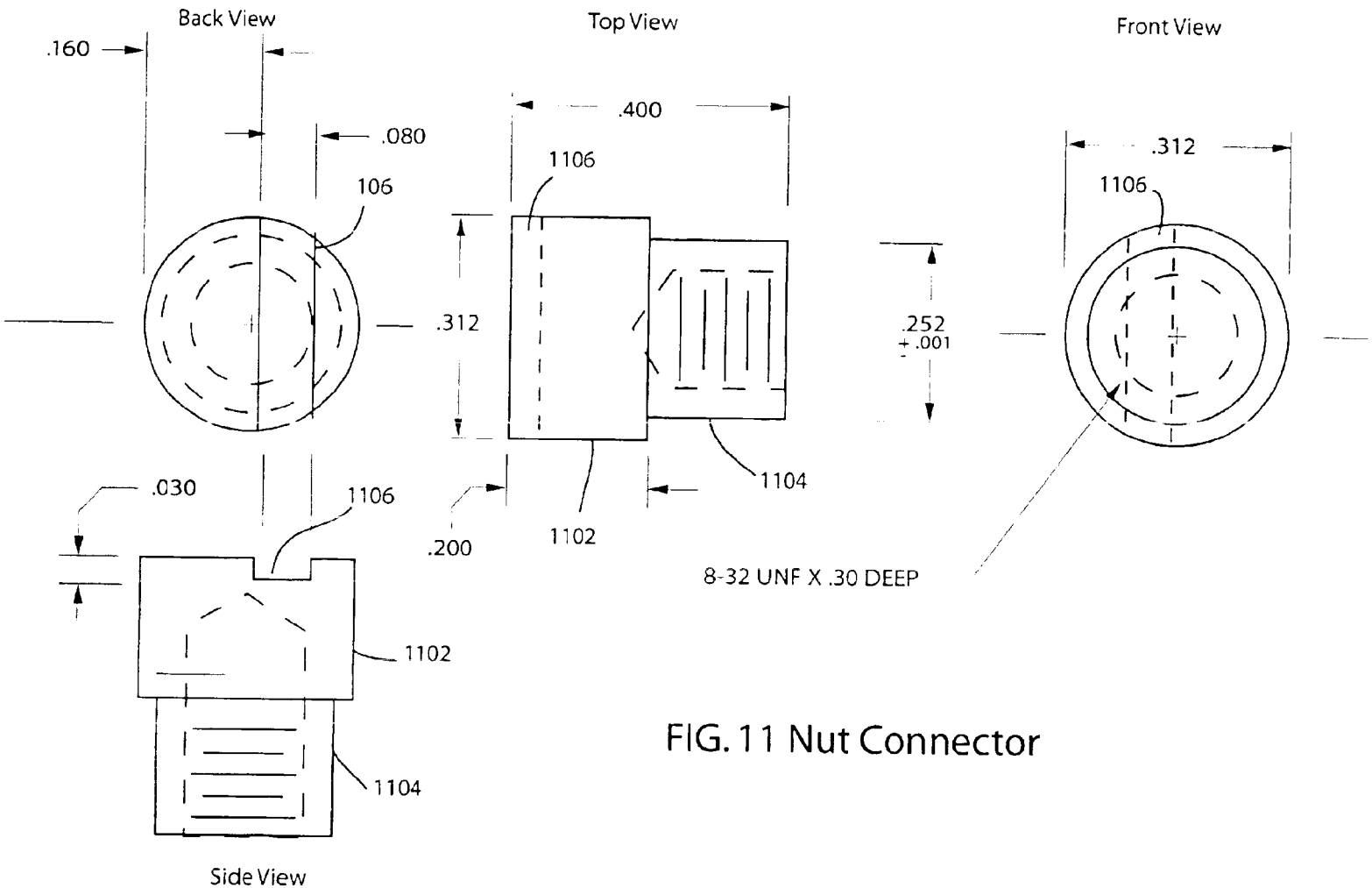
FIG. 11 Nut Connector

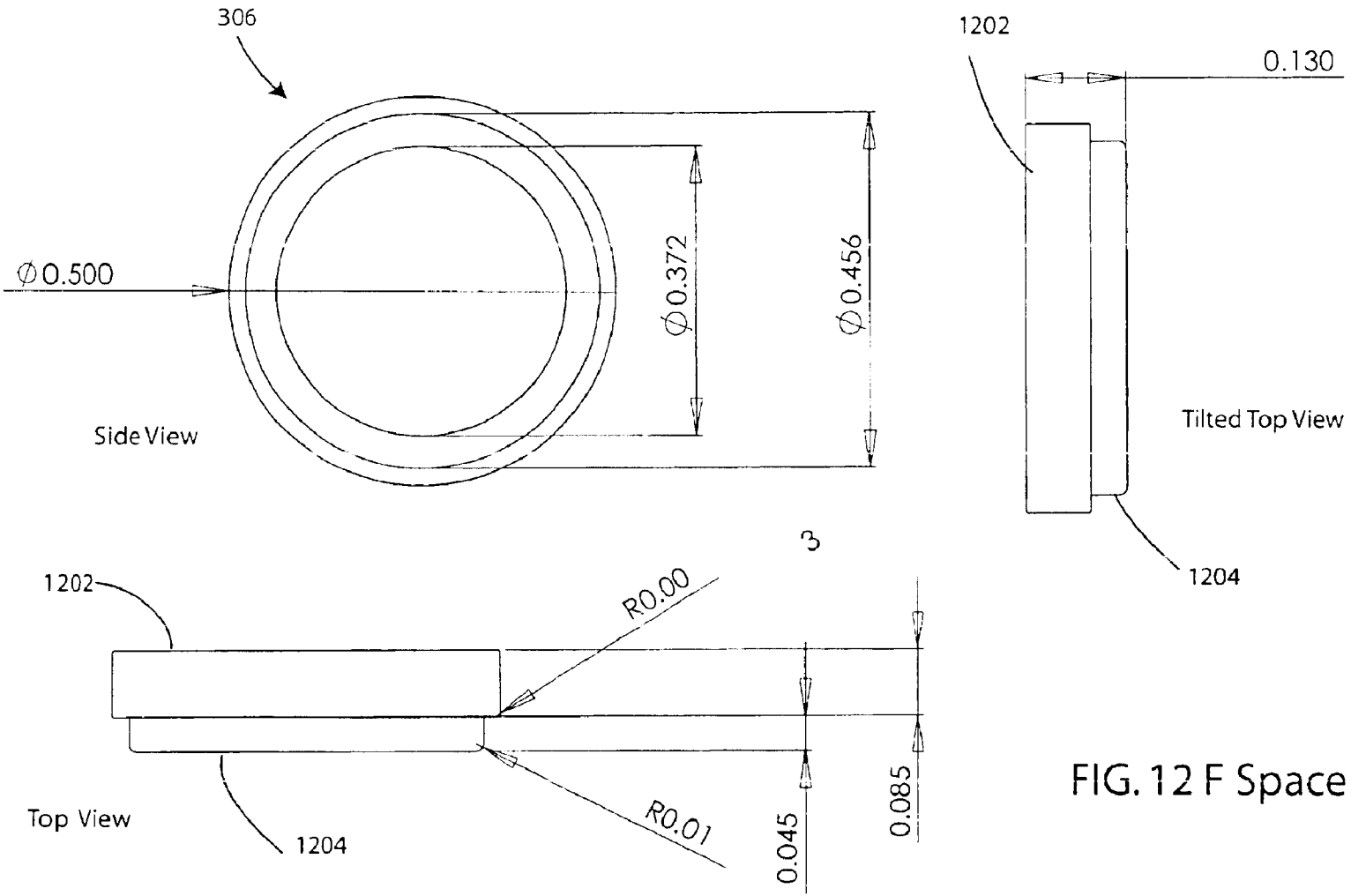
FIG. 12 F Spacer

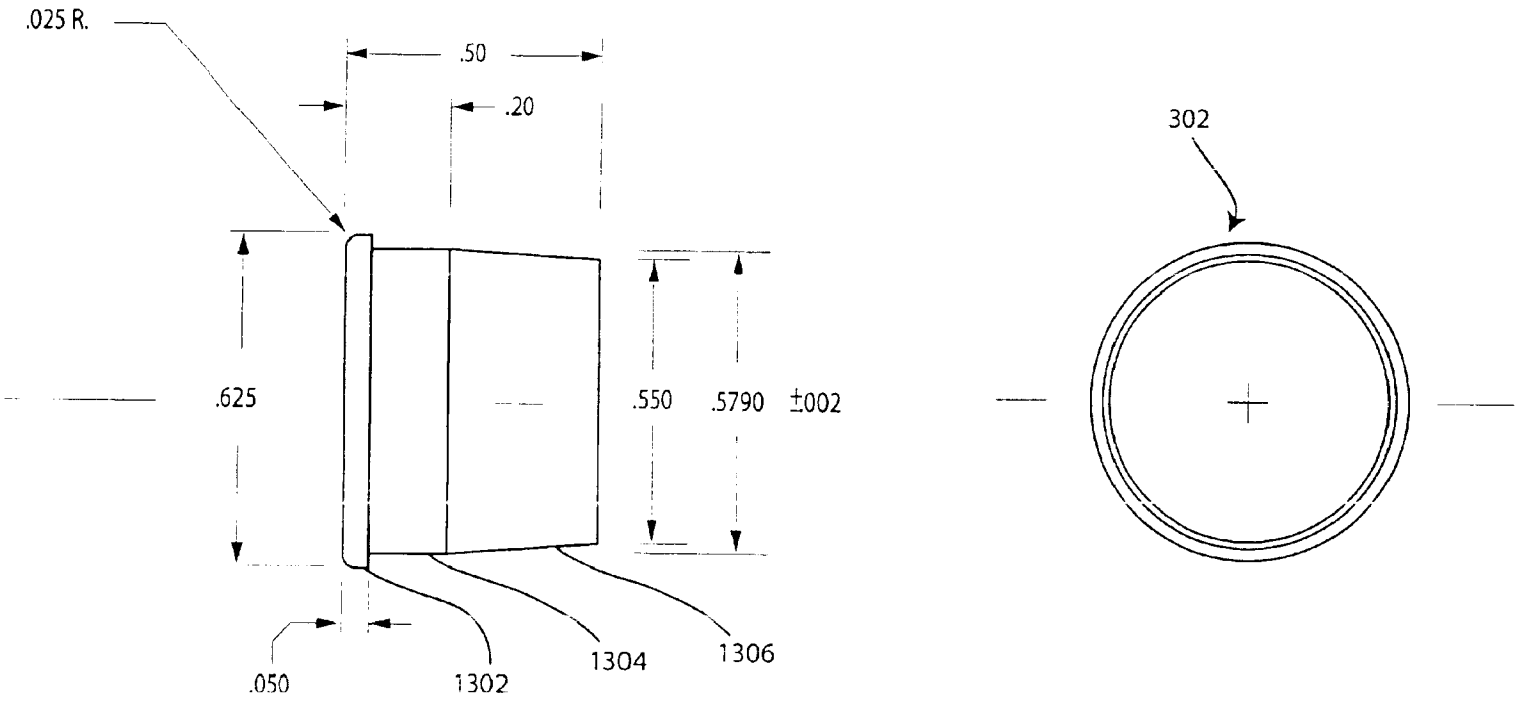
FIG. 13B Driver Cap

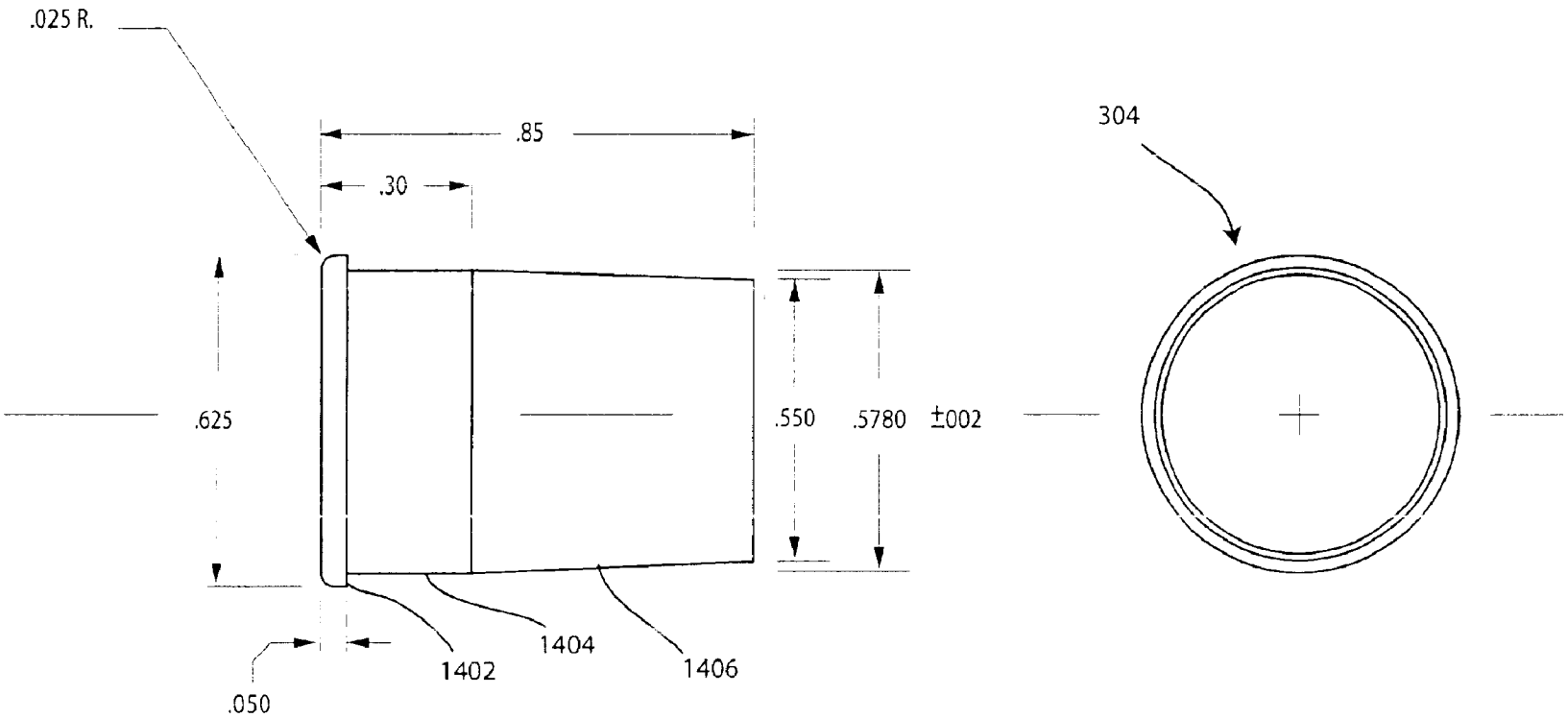
FIG. 14 Cap

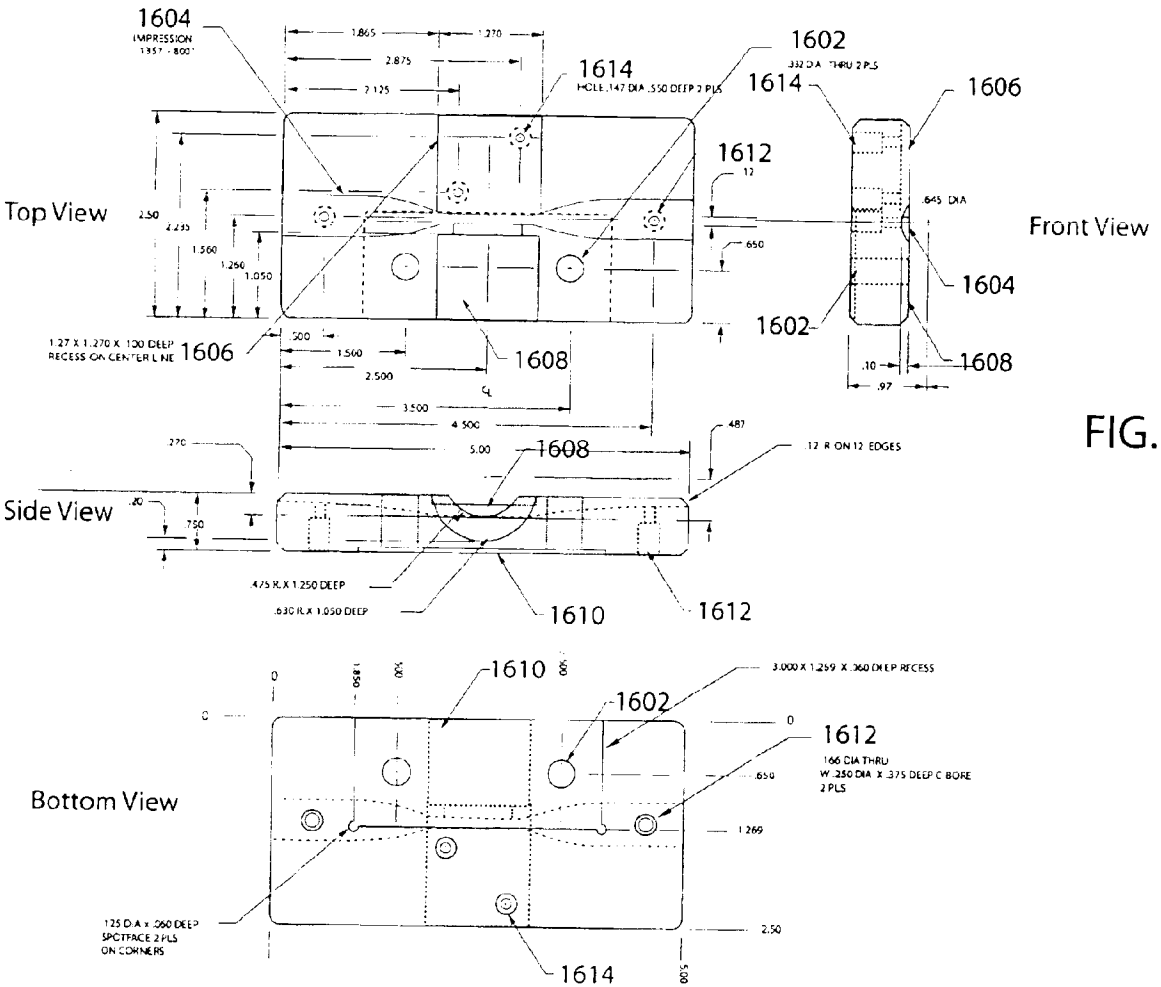
FIG. 17 Mounting Block

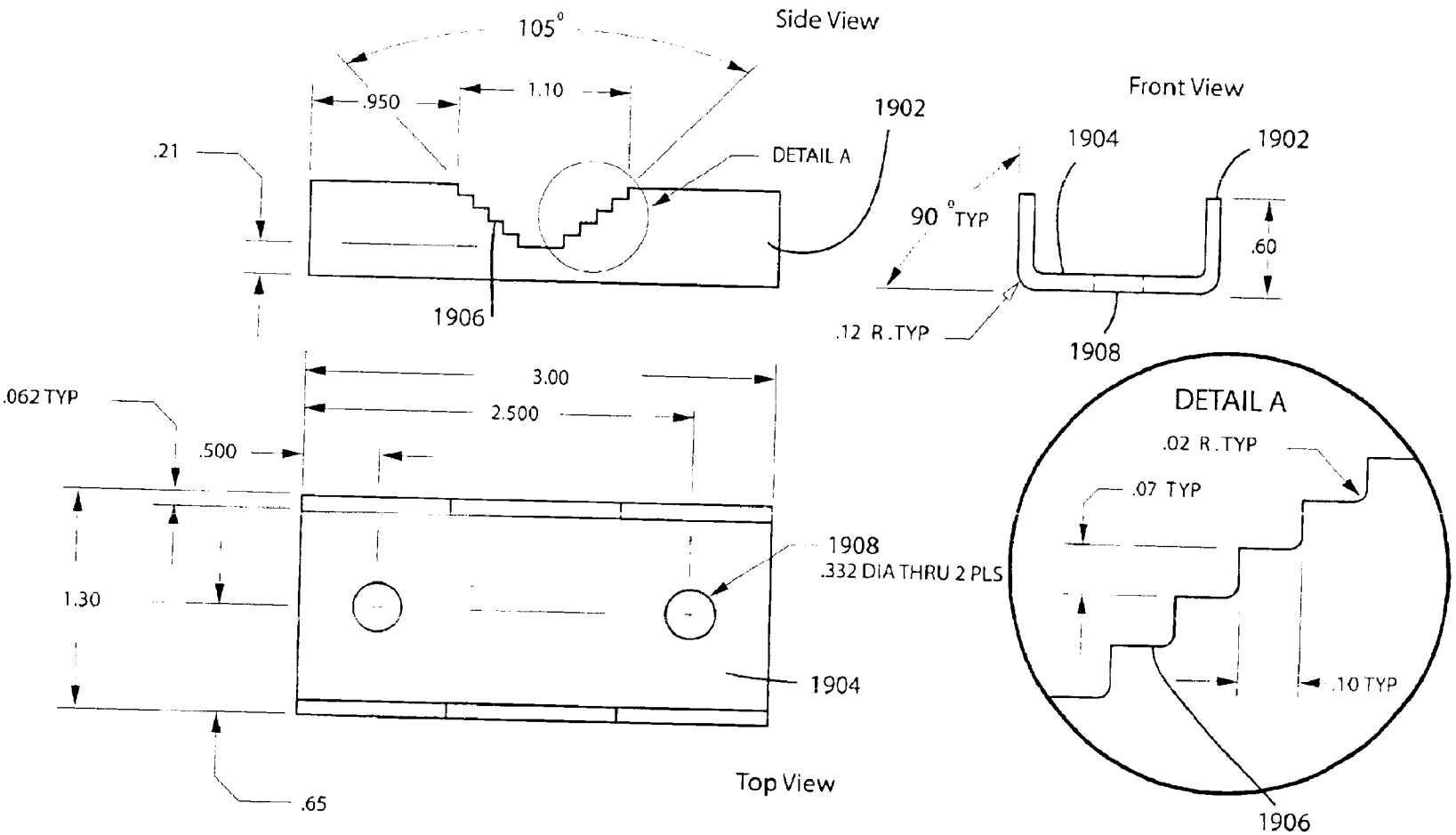
FIG. 19 Cleat

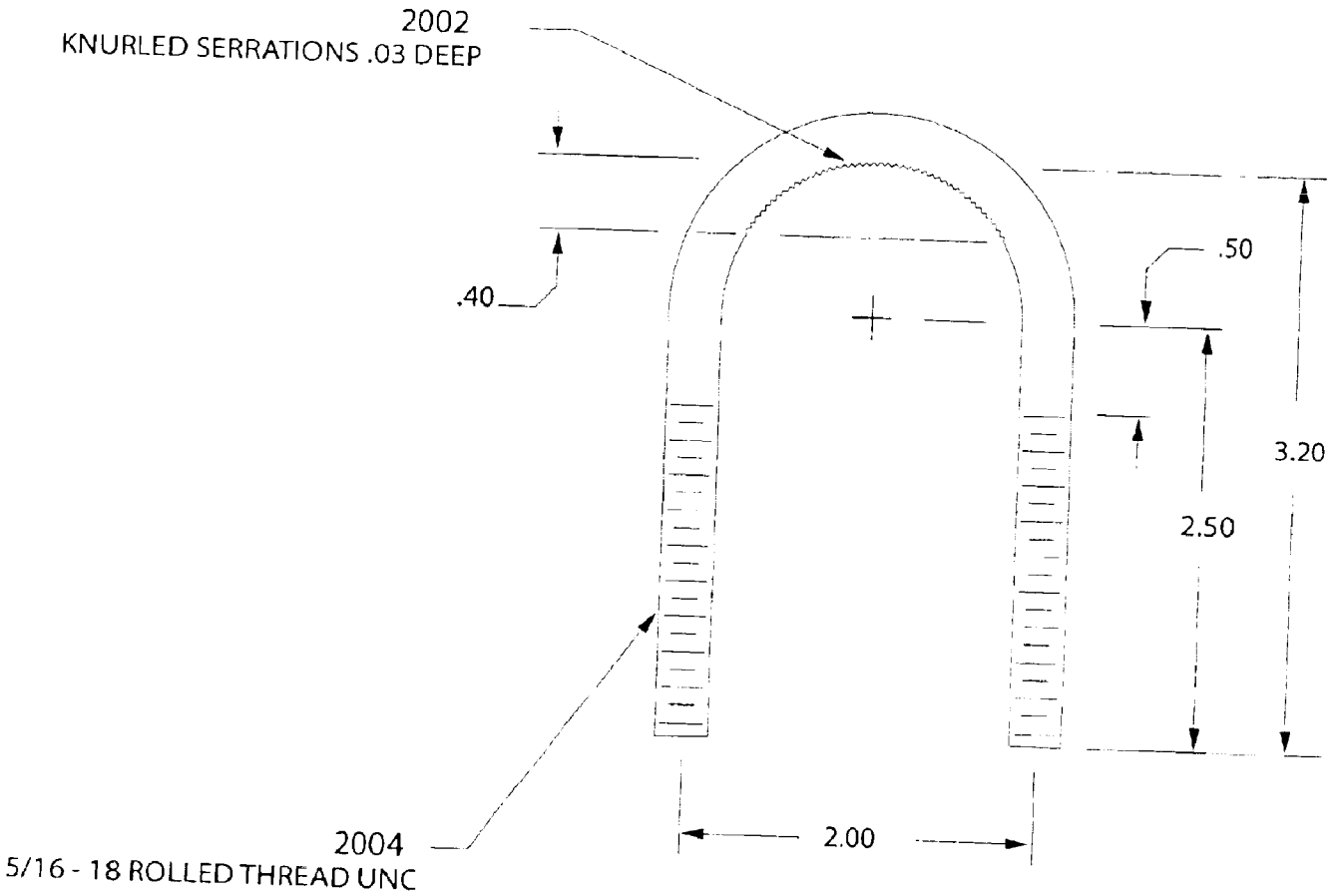
FIG. 20 U-Bolt

HORIZONTAL POLARIZED BI-DIRECTIONAL FM STEREO ANTENNA

FIELD OF THE INVENTION

The present invention relates to frequency modulation (FM), and more particularly to very high frequency (VHF) FM stereo antennas.

BACKGROUND OF THE INVENTION

FM antennas are well known in the art. At times, certain FM channels are difficult to receive. There are various reasons for this difficulty. For example, the power of the signal from the transmitter may be low, the receiver may be a long distance away from the transmitter, or the path of the signal may be obstructed.

Conventional antennas are inadequate to address these problems for several reasons. Some conventional antennas are shaped to be omni-directional, such as in an S shape. They attempt to receive signals from many directions. However, when the antenna receives a selected signal from one direction, common multi-path signals from other directions interfere with this signal. This reduces the signal strength and/or introduces noise. Thus, for signals that are already difficult to receive, the antenna is inadequate. In addition to being omni-directional, some conventional antennas receive reflections of the signals from obstructions. These reflected signals also interfere with the original signal, reducing its strength.

Some conventional antennas attempt to compensate for these problems by being very large. However, these large antennas are cumbersome and are often expensive. Typically, they require guide wires to anchor them. Some conventional antennas include amplifiers in the antenna. However, the amplifiers, although potentially helpful with weak signals, can become overloaded by strong signals, resulting in intermodulation distortion. This causes many users to turn off the amplifier.

In addition, the effectiveness of many conventional antennas deteriorate over time. The antennas are manufactured with rivets and other similar fasteners, as well as other components which may be sensitive to the weather. For example, rust and other corrosion at the rivets results in the degradation of the selected signal and enhancement of noise to the overall reception. Also due to their sensitivity to the weather, many conventional antennas break or bend in strong wind.

Accordingly, there exists a need for an improved FM antenna. The antenna should be bi-directional, hermetically sealed, and of sturdy construction to withstand the elements over a significant period of time. The present invention addresses such a need.

SUMMARY OF THE INVENTION

A frequency modulation antenna includes: a hermetically sealed driver assembly, which includes a driver tube, a gamma tube, a spacer stamping between the driver tube and the gamma tube, and an impedance matching block assembly between the driver tube and the gamma tube. The antenna eliminates conventional sources of signal degradation and interference due to its bi-directional nature, the hermetic sealing of the driver assembly, the coupling methods that prevent corrosion, and the dielectric coating. The antenna is further mounted to provide strength against the elements, facilitated by the precise mating of the driver assembly, the impedance matching block assembly, and a cleat to the mounting block, and the engagement of the teeth of the cleat and the serrations of a U-bolt to a pole. The antenna is significantly smaller than many conventional antennae while still being able to receive signals of low power without undue degradation or interference.

BRIEF DESCRIPTION OF THE FIGURES

FIG. 3 illustrates in more detail the driver assembly of the antenna in accordance with the present invention.

FIG. 4 illustrates in more detail the driver tube of the driver assembly in accordance with the present invention.

FIG. 5 illustrates in more detail the gamma tube of the driver assembly in accordance with the present invention.

FIGS. 6A and 6B illustrate in more detail the spacer stamping of the driver assembly in accordance with the present invention.

FIGS. 8A and 8B illustrate in more detail the matching block case of the impedance matching block assembly in accordance with the present invention.

FIG. 9 illustrates in more detail the printed circuit board of the impedance matching block assembly in accordance with the present invention.

FIG. 10 illustrates in more detail the printed circuit board thread of the impedance matching block assembly in accordance with the present invention.

FIG. 11 illustrates in more detail the nut connector of the impedance matching block assembly 106 in accordance with the present invention.

FIG. 12 illustrates in more detail the F spacer of the driver assembly in accordance with the present invention.

FIGS. 13A and 13B illustrate in more detail the driver cap of the driver assembly in accordance with the present invention.

FIG. 14 illustrates in more detail the cap of the gamma tube assembly in accordance with the present invention.

FIGS. 16A-17 illustrate in more detail the mounting block of the mounting block assembly in accordance with the present invention.

FIG. 19 illustrates in more detail the cleat of the mounting block assembly in accordance with the present invention.

FIG. 20 illustrates in more detail the U-bolt of the mounting block assembly in accordance with the present invention.

DETAILED DESCRIPTION

The present invention provides an improved FM antenna. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The antenna in accordance with the present invention eliminates conventional sources of signal degradation and interference due to its bi-directional nature, the hermetic sealing of the driver assembly, the coupling methods that prevent corrosion, and its dielectric coating. The antenna is mounted to provide strength against the elements, facilitated by the precise mating of a mounting block assembly to the driver assembly. The antenna is significantly smaller than many conventional antennae while still being able to receive signals of low power without undue signal degradation or interference.

To more particularly describe the features of the present invention, please refer to FIGS. 1A through 20 in conjunction with the discussion below. The Figures include example dimensions in inches.

Figure 1A:
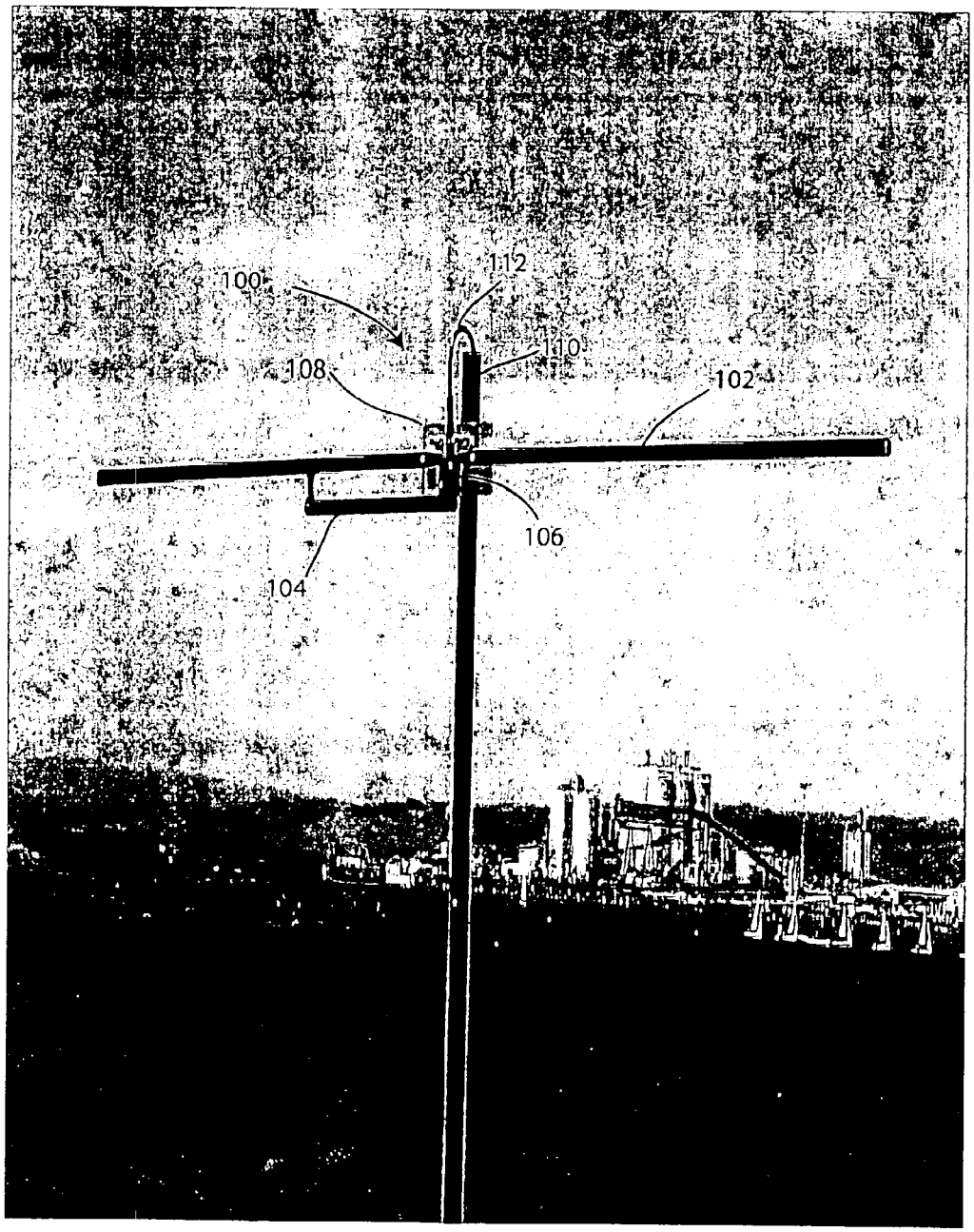
FIGS. 1A and 1B are photographs of a preferred embodiment of a frequency modulation antenna in accordance with the present invention.
Figure 1B:
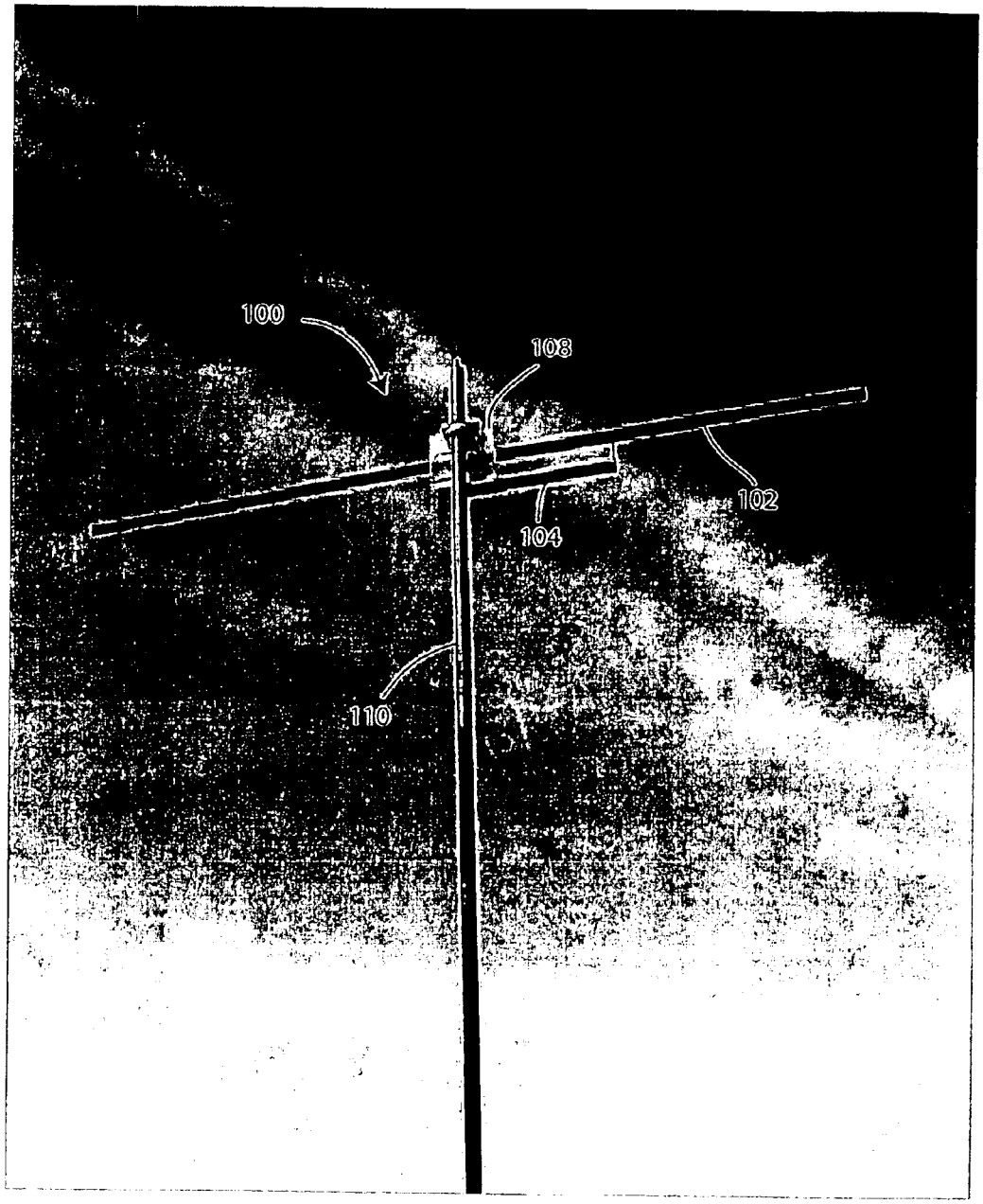
Figure 2:
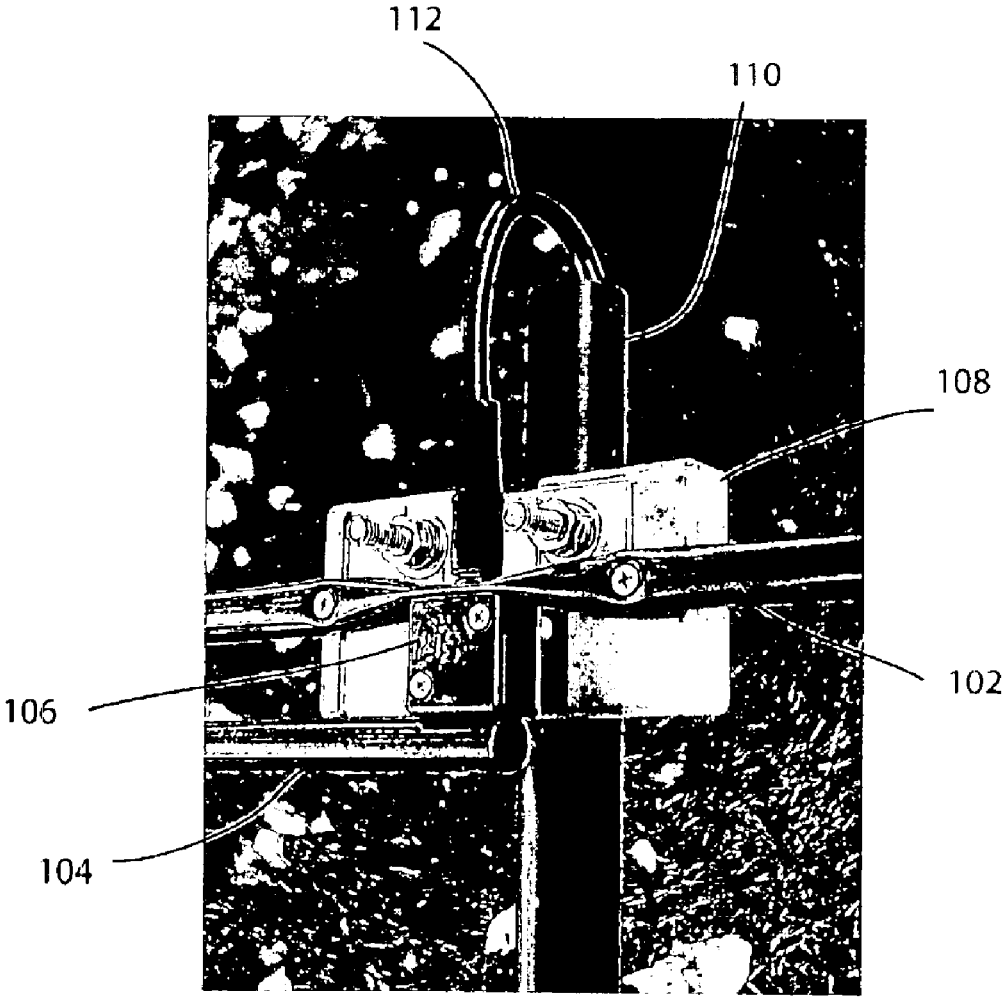
FIG. 2 is a photograph of a close-up of the matching and mounting blocks of the antenna in accordance with the present invention.

FIGS. 1A and 1B are photographs of a preferred embodiment of a FM antenna in accordance with the present invention. FIG. 2 is a photograph of a close-up of the matching and mounting blocks of the antenna in accordance with the present invention. The antenna 100 comprises a driver assembly, which comprises a driver tube 102, a gamma tube 104 coupled to the driver tube 102, and an impedance matching block assembly 106 coupled to the driver tube 102 and the gamma tube 104. The antenna 100 further comprises a mounting block assembly 108 coupled to the driver assembly. The mounting block assembly 108 couples the driver assembly to a pole 110. A transmission line 112 couples to the driver assembly for transferring a signal received by the driver assembly to a receiver (not shown). The driver assembly and the transmission line 112 are coated, and the gamma tube 104, matching block 106, spacer stamping 310, F Spacer 306, and the F connector 308 are partially coated, with a dielectric material to hermetically seal these components and for proper electric discharge. The pole 110 is mounted using a mast mount (not shown).

FIG. 3 illustrates in more detail the driver assembly of the antenna 100 in accordance with the present invention. In the preferred embodiment, the length of the driver tube 102 is approximately half of the wavelength of 94 MHz, or approximately 60 inches. Other wavelengths can be used to determine the length of the driver tube 102. The length of the gamma tube 104 is approximately ⅕ of the length of the driver tube 102. Driver caps 302 seal each end of the driver tube 102 and one end of the gamma tube 104. The other end of the gamma tube 104 is sealed with a cap 304 which is longer than the driver caps 302. A spacer stamping 310 couples one end of the gamma tube 104 to the driver tube 102. The spacer stamping 310 is of a length and at a location that allows the distance between the center of the driver tube 102 diameter and the center of the gamma tube 104 diameter to approximately represent the impedance of the transmission line connection at an F connector 308. A slight mismatch of the impedance can still remain, however. This slight mismatch is compensated by the impedance matching block assembly 106, which comprises a capacitor and a printed circuit board (PCB). By matching the impedance, the phase of the received signal is such that the signal is not reflected back through the gamma tube 104, preventing attenuation and intermodulation distortion. An F spacer 306 couples the impedance matching block assembly 106 and the F connector 308 to the driver tube 102. The gamma tube 104 is coupled to the impedance matching block assembly 106 by a screw 312. The screw 312 traverses the diameter of the gamma tube 104 and assists in maintaining proper contact for signal transfer from the gamma tube 104 to the impedance matching block assembly 106.

The overall shape of the driver assembly is such that the antenna 100 receives the magnetic wave of the FM signals, and such that the antenna 100 receives signals in two directions, perpendicular to the length of the tubes 102 and 104. The antenna 100 rejects signals from other directions, thus blocking a significant source of multi-path noise and interference. The dielectric coating (not shown) on the tubes 102 and 104 reject the electrical component of unwanted signals, further preventing a source of noise and interference. In the preferred embodiment, the dielectric rating of the coating is such that any electric charge that remain on the surface of the coating is slowly discharged.

FIG. 4 illustrates in more detail the driver tube 102 of the driver assembly in accordance with the present invention. In the preferred embodiment, the driver tube 102, without the driver caps 302, is approximately 59.9 inches and 0.625 inches in diameter. A portion 404 of the driver tube 102 is crimped for the purpose of coupling it to the impedance matching block assembly 106. A bore 406 resides in the crimped portion 404, through which the F spacer 306 couples the impedance matching block assembly 106 and the F connector 308 to the driver tube 102, the F spacer 306 and the F connector 308 are described in more detail later. The driver tube 102 comprises additional bores 402 for mounting the driver tube 102 to the mounting block assembly 108. In the preferred embodiment, screws are used through the bores 402. O-rings reside at these bores 402 to hermetically seal this joint.

FIG. 5 illustrates in more detail the gamma tube 104 of the driver assembly in accordance with the present invention. In the preferred embodiment, the gamma tube 104, with the cap 304, is approximately 11.975 inches in length. In the preferred embodiment, the diameter of the gamma tube 104 is approximately equal to the diameter for the driver tube 102. The gamma tube 104 comprises a bore 502 through which the screw 312 couples the gamma tube 104 to the impedance matching block assembly 106. The length of the cap 304 is longer than the length of the driver caps 302 to accommodate for the screw 312.

Figure 6A:
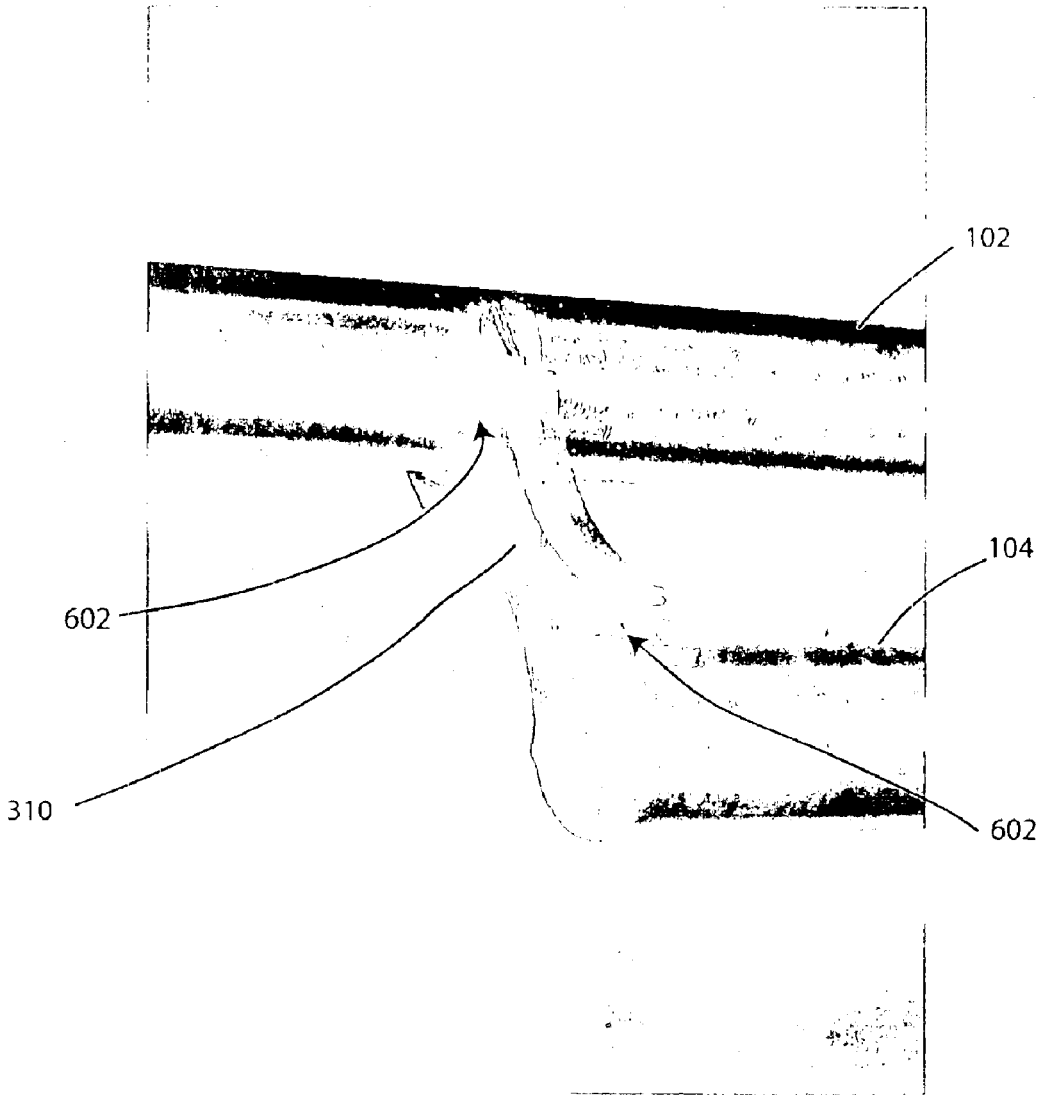

FIGS. 6A and 6B illustrate in more detail the spacer stamping 310 of the driver assembly in accordance with the present invention. FIG. 6A is a close-up photograph of the spacer stamping 310. Solder 602 is used to couple the spacer stamping 310 to the driver tube 102 and the gamma tube 104. FIG. 6B is a drawing of the spacer stamping 310 with example dimensions. Solder 602 is applied at the curved ends of the spacer stamping 310 to couple it to the driver 102 and gamma 104 tubes. The spacer stamping 310 taps the received signal off of the driver tube 102, and sends the signal to the gamma tube 104. The signal then travels through the impedance matching block assembly 106, and then to the transmission line 112. Because solder is used to couple the driver tube 102 and the gamma tube 104 instead of rivets or bolts, the possibility of rust and/or corrosion occurring at this joint is minimized.

Figure 7:
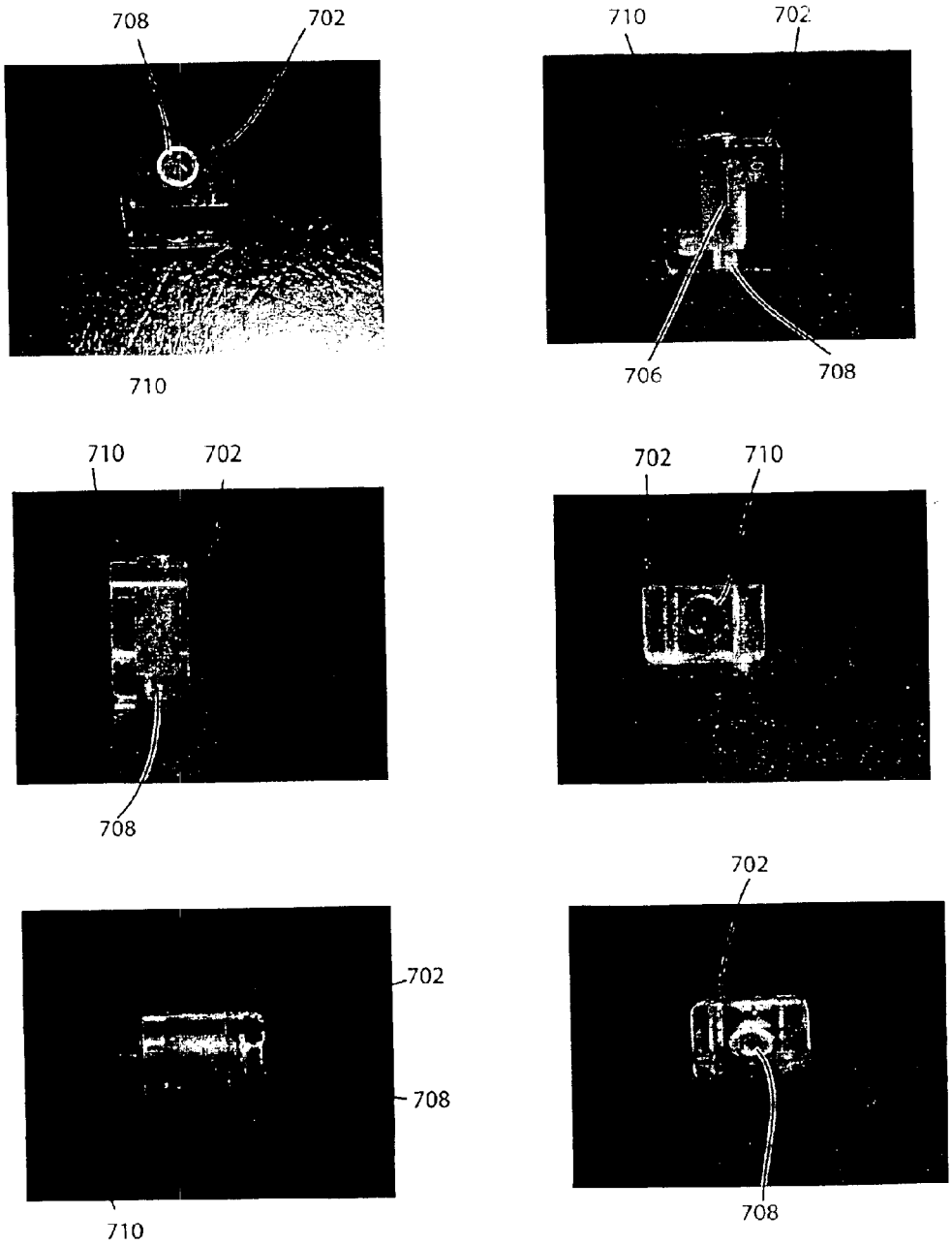
FIG. 7 illustrates in more detail the impedance matching block assembly of the antenna in accordance with the present invention.

FIG. 7 illustrates in more detail the impedance matching block assembly 106 of the antenna 100 in accordance with the present invention. It comprises a matching block case 702 composed of acrylic. Within the case 702 are a capacitor (not shown), a printed circuit board (PCB) 706, a nut connector 708, and a PCB thread 710. The capacitor and the PCB 706 compensate for any mismatch in the residual inductance from the gamma tube 104. The PCB thread 710 couples to the F connector 308, transferring the signal to the transmission line 112 that couples to the F connector 308. The nut connector 708 couples to the screw 312 (see FIG. 3).

FIGS. 8A and 8B illustrate in more detail the matching block case 702 of the impedance matching block assembly 106 in accordance with the present invention. FIG. 8A is a photograph of the matching block case 702. FIG. 8B is a drawing of the matching block case 702. The case 702 comprises a bore 810 within which resides the PCB assembly, the PCB 706, the nut connector 708, and the PCB thread 710. At one end 812 of the bore 810 resides the nut connector 708. At the other end 814 of the bore 810 resides the PCB thread 710. In the preferred embodiment, at the end 814, the surface of the matching block case 702 has an arc 802 (see FIG. 8B left side view). The arc 802 also exists on the nut connector 708. In the preferred embodiment, the radius of the arc 802 matches the radius of the gamma tube 104. The arc 802 allows the gamma tube 104 to make optimal contact with the nut connector 708 once the screw 312 is in place. Such a contact minimizes the possibility of oxidation and/or corrosion, another possible source of noise and interference. The case 702 also comprises bores 806 for screws to couple the impedance matching block assembly 106 to the mounting block assembly 108. Another bore 804 allows injection of a high strength epoxy to encapsulate the PCB assembly and for bonding, sealing and enhancing the dielectric properties of the impedance matching circuit in the matching block assembly 106.

FIG. 9 illustrates in more detail the PCB of the matching block assembly 106 in accordance with the present invention. The PCB 706 comprises several pads, including a pad 902 to which the nut connector 708 is soldered, pads 904 to which the capacitor is soldered, pads 906 to which the PCB thread 710 is soldered, and a pad 908 to which a copper plated pin is soldered. The copper plated pin transmits the received signal to the transmission line 112. On the opposite side of the PCB 706 is a ground plane 910. The ground plane 910 provide shielding for the pad 908.

FIG. 10 illustrates in more detail the PCB thread 710 of the impedance matching block assembly 106 in accordance with the present invention. The PCB thread 710 comprises a barrel 1002 in which threads are created, and forks 1004 which are soldered onto the pads 906 and the ground plane 910 (see FIG. 9) to couple the PCB thread 710 to the PCB 706. The copper plated pin protrudes from the center of the barrel 1002.

FIG. 11 illustrates in more detail the nut connector 708 of the impedance matching block assembly 106 in accordance with the present invention. The nut connector 708 comprises a larger first portion 1102 and a smaller second portion 1104. The second portion 1104 is threaded so that the screw 312 can couple to the nut connector 708. The first portion 1102 comprises a slot 1106, into which the PCB 706 resides.

FIG. 12 illustrates in more detail the F spacer 306 of the driver assembly in accordance with the present invention. The F spacer 306 comprises a larger diameter first portion 1202 and a smaller diameter second portion 1204. It fits within the bore 406 of the driver tube 102 (see FIG. 4). The diameter of the second portion 1204 is slightly larger than the diameter of the bore 406. The F spacer 306 is press-fitted within the bore 406 simultaneously to the coupling of the F connector 308 to the PCB thread 710. Because the diameter of the second portion 1204 is slightly larger than the bore 406, the bore 406 is slightly stretched. This creates a hermetic seal and an electrical contact.

Figure 13A:
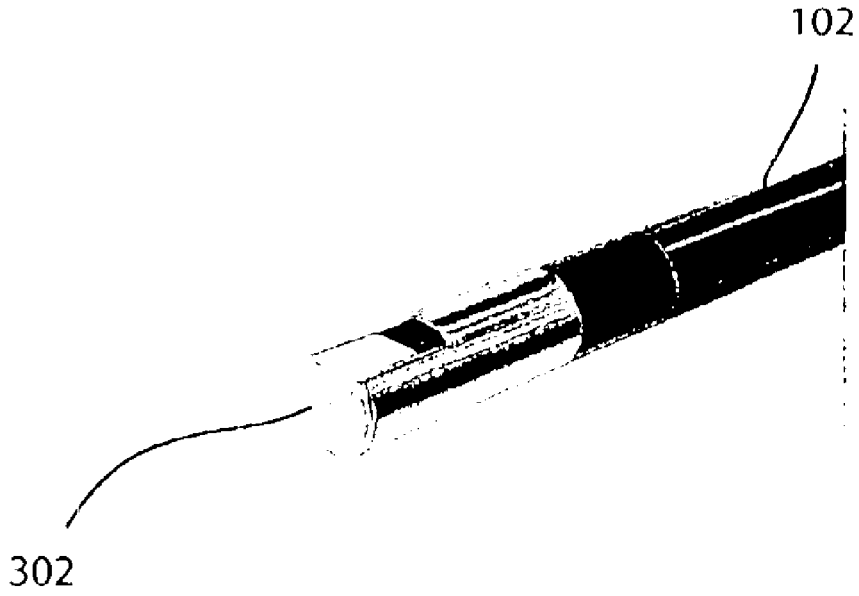

FIGS. 13A and 13B illustrate in more detail the driver cap 302 of the driver assembly in accordance with the present invention. FIG. 13A is a photograph of the driver cap 302 inserted into the driver tube 102, with a section of the driver tube 102 removed. FIG. 13B is a drawing of the driver cap 302. The driver cap 302 comprises a rim section 1302, a first portion 1304 of an insert, and a second portion 1306 of the insert. The rim section 1302 comprises a small metallic surface which assists in discharging any electrical charge on the surface of the driver 102 or gamma 104 tubes, once the dielectric coating is placed. The insert is composed of a metallic material. The insert is press-fitted into the tubes 102 and 104. The second portion 1306 of the insert has a slight taper to facilitate the press-fitting. The driver cap 302 creates a hermetic seal at the end of the tubes 102 and 104.

FIG. 14 illustrates in more detail the cap 304 of the driver assembly in accordance with the present invention. The cap 304 comprises a rim section 1402, a first portion 1404 of the insert, and a second portion 1406 of the insert. The second portion 1406 also has a slight taper to facilitate the press-fitting of the cap 304 into the gamma tube 104. The cap 304 creates a hermetic seal at the end of the gamma tube 104. The length of the cap 304 is longer than the length of the driver caps 302 to accommodate for the screw 312. After the cap 304 is pressed into the gamma tube 104, the bore 502 is created.

Figure 15:
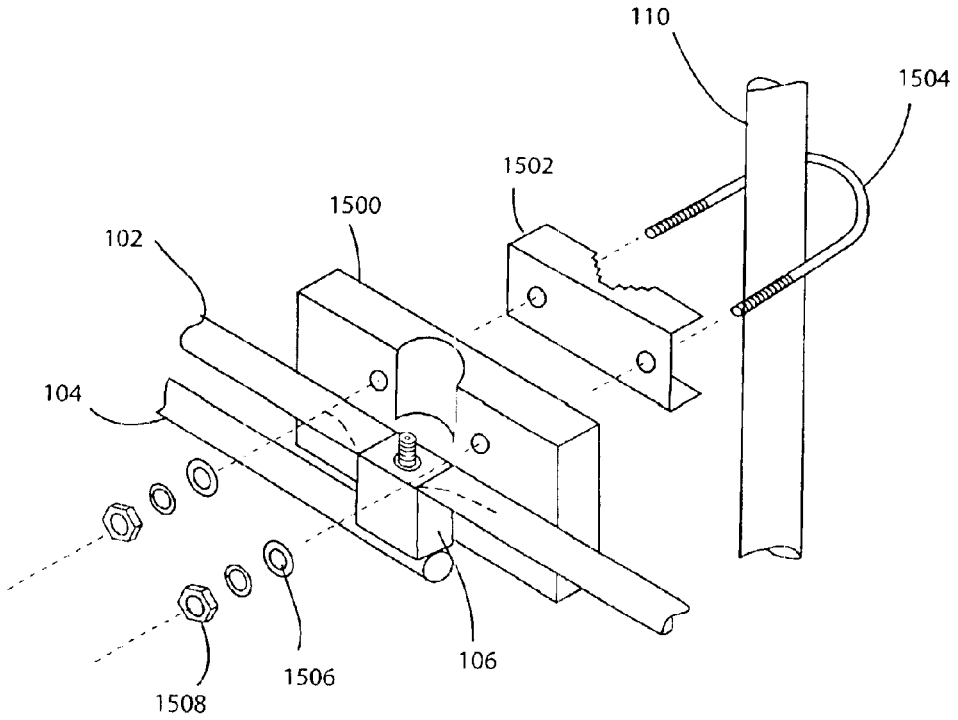
FIG. 15 illustrates an exploded view of the mounting block assembly of the antenna in accordance with the present invention.

FIG. 15 illustrates an exploded view of the mounting block assembly 108 of the antenna 100 in accordance with the present invention. The mounting block assembly 108 comprises a mounting block 1500, a cleat 1502, and a U-Bolt 1504. The U-bolt 1504 couples the cleat 1502 and the mounting block 1500 (to which the driver assembly is coupled) to the pole 110, anchoring the antenna 100. Washers 1506 and nuts 1508 secure the U-bolt 1504. The washers 1506 assists in keeping the nuts 1508 locked under high wind vibration due to high wind pulses.

Figure 16A:
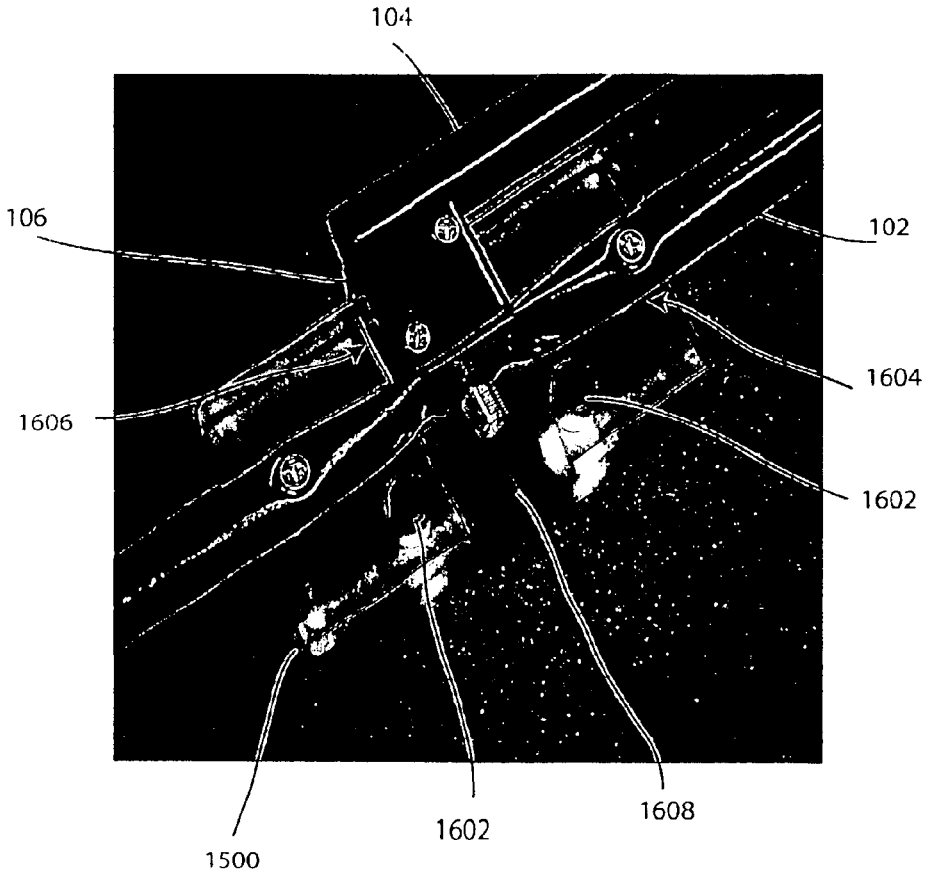
Figure 16B:
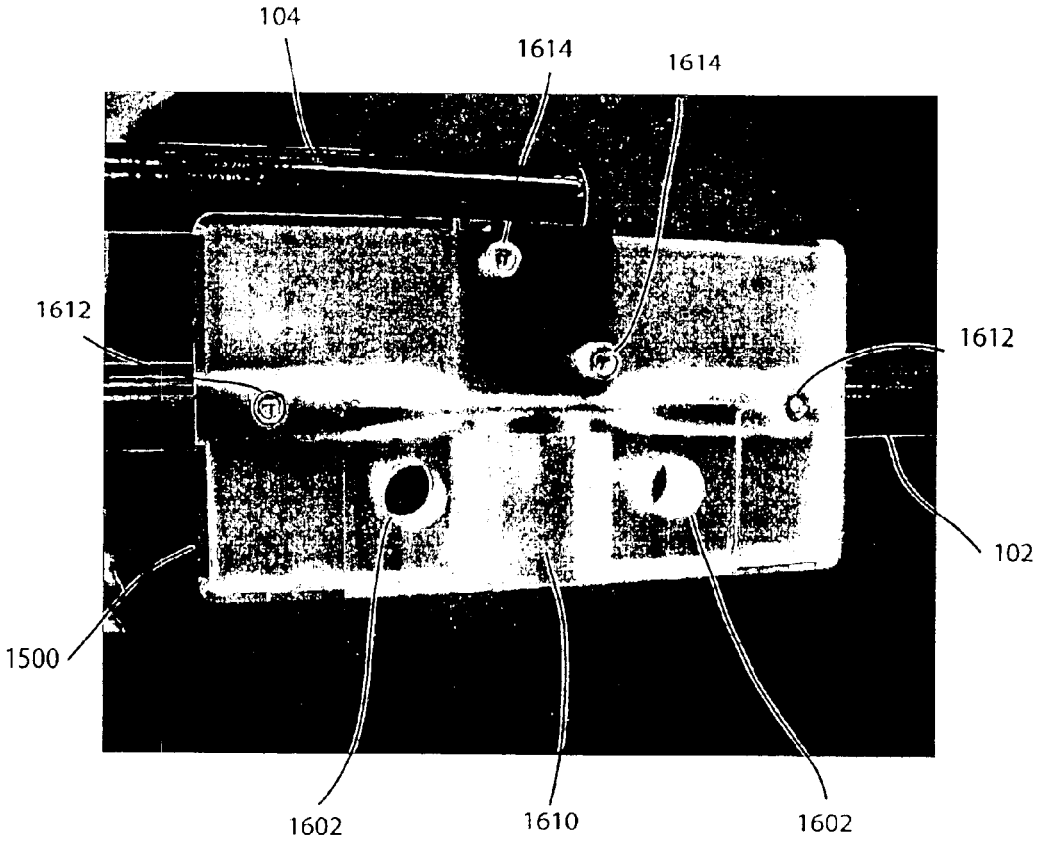

FIGS. 16A-17 illustrate in more detail the mounting block 1500 of the mounting block assembly 108 in accordance with the present invention. FIGS. 16A and 16B are photographs of the mounting block 1500 coupled to the driver assembly. FIG. 17 has drawings of the mounting block 1500. As shown in FIGS. 16A and 17, the mounting block 1500 comprises bores 1602 for the U-bolt 1504, a recess 1604 in which the driver tube 102 resides, a recess 1606 in which the impedance matching block assembly 106 resides, and a recess 1608 in which the transmission line 112 resides. As shown in FIGS. 16B and 17, the mounting block 1500 further comprises a recess 1610 in which the cleat 1502 resides, bores 1612 within the recess 1604 for coupling the driver tube 102 to the mounting block 1500, and bores 1614 within the recess 1606 for coupling the impedance matching block assembly 106 to the mounting block 1500. The bores 1612 match the locations of the bores 402 on the driver tube 102 (see FIG. 4), while the bores 1614 match the locations of the bores 806 of the matching block case 702 (see FIG. 8B).

In the preferred embodiment, the recess 1604 is formed by first digitizing an image of the section of the driver tube 102 proximate to the crimped portion 404. The digitized image is then used to produce a mirror image of it in the mounting block 1500, using a ball in mill. This results in a precise mating of the driver tube 102 to the mounting block 1500 within the recess 1604. The driver tube 102 snaps into the completed recess 1604, with the bores 1612 in the mounting block 1500 lined up with the bores 402 in the driver tube 102. The driver tube 102 is secured in place with screws through threaded inserts in the bores 402 and 1612. The impedance matching block assembly 106 also precisely mates with the mounting block 1500 within the recess 1606, secured in placed with screws through threaded inserts in the bores 1614 in the mounting block 1500 lined up with the bores 806 in the matching block case 702. The impedance matching block assembly 106 is secured in placed with screws through the bores 806 and 1614. The precise mating of the driver assembly with the mounting block 1500 provides high physical integrity for the antenna 100. The driver assembly is unlikely to tear away from or move within the mounting assembly 108, even under high winds. This high physical integrity is maintained over a significant period of time.

Figure 18:
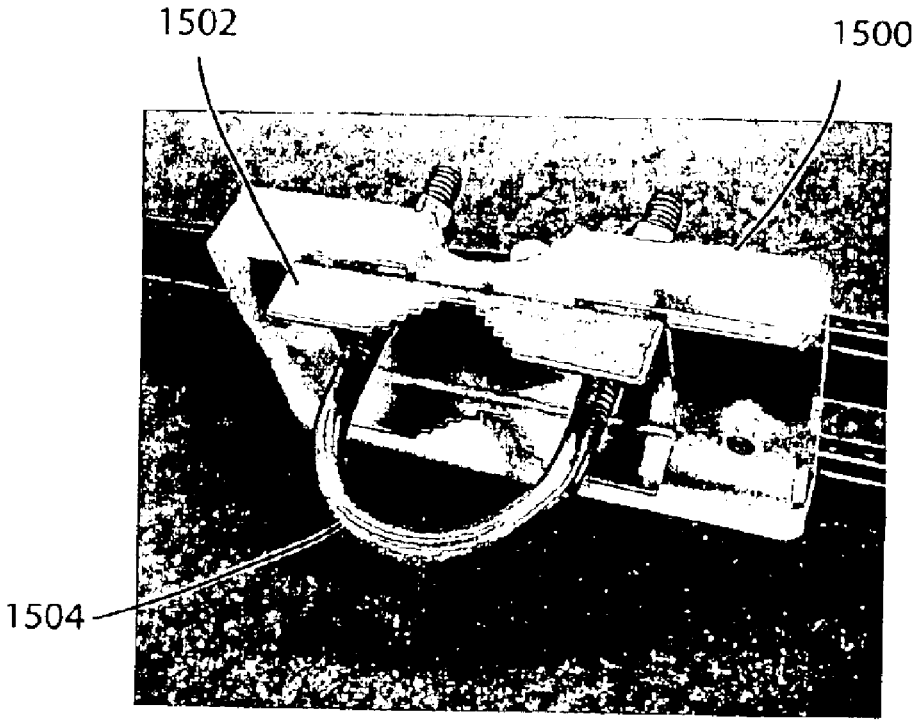
FIG. 18 is a photograph of the cleat and the U-bolt of the mounting block assembly in accordance with the present invention.

FIG. 18 is a photograph of the cleat 1502 and the U-bolt 1504 of the mounting block assembly 108 in accordance with the present invention. FIG. 19 illustrates in more detail the cleat 1502 of the mounting block assembly 1500 in accordance with the present invention. The cleat 1502 comprises two sides 1902 and a bottom 1904. The bottom 1904 comprises bores 1908 through which the U-bolt 1504 traverses. The sides 1902 comprise a plurality of teeth 1906. The teeth 1906 engage the pole 110 without piercing the pole 110, assisting in keeping the antenna 100 in place. FIG. 20 illustrates in more detail the U-bolt 1504 of the mounting block assembly 108 in accordance with the present invention. The U-bolt 1504 comprises serrations 2002 on the inside of the bend. The serrations 2002 engage the pole 110, and with the teeth 1906 of the cleat 1502, they assist in keeping the antenna 100 in place. The U-bolt 1504 further comprises threads 2004 at each end to engage the nuts 1508.

The antenna in accordance with the present invention eliminates many of the conventional sources of signal degradation and interference. The bi-directional, rather than omni-directional, nature of the antenna results in the antenna receiving a signal in two directions while rejecting unwanted signals from other directions. The hermetic sealing of the driver assembly prevents corrosion of the components that may lead to signal degradation. For example, the driver caps 302 and the cap 304 hermetically seal the ends of the driver tube 102 and gamma tube 104. The F spacer 306 hermetically seals the coupling between the impedance matching block assembly 106, the driver tube 102, and the F connector 308. The coupling methods used in the antenna also prevents such corrosion. For example, the press-fitting of the caps 302 and 304 and the soldering of the spacer stamping 310 are used instead of rivets or bolts. The O-rings 1506 at the bores 402 of the driver assembly prevents moisture from entering the driver tube 102. The dielectric coating further provides a hermetic seal and protection against corrosion.

The antenna is further mounted to provide strength against the elements. This is facilitated by the precise mating of the driver assembly to the mounting block assembly 108 through the various features of the mounting block 1500. For example, the driver tube 102 is precisely mated to the mounting block 1500 within the recess 1604. The strength is further facilitated by the precise mating of the impedance matching block assembly 106 to the mounting block 1500 within the recess 1606. The precise mating of the cleat 1502 to the mounting block 1500 within recess 1610 also provides strength to the antenna mounting, as well as the engagement of the cleat's teeth 1906 and the U-bolt's serrations 2002 to the pole 110.

The above described features of the antenna allows it to be significantly smaller than many conventional antenna while still being able to receive signals of low power without undue degradation or interference. Amplifier circuits are thus not required.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A frequency modulation (FM) antenna, comprising:
a hermetically sealed driver assembly, comprising:
a driver tube,
a gamma tube,
a spacer stamping coupled between the driver tube and the gamma tube,
an impedance matching block assembly coupled between the driver tube and the gamma tube, and
a plurality of caps coupled to ends of the driver tube and the gamma tube, wherein the plurality of caps hermetically seal the ends of the driver tube and the gamma tube.

2. A frequency modulation (FM) antenna, comprising:
a hermetically sealed driver assembly, comprising:
a driver tube,
a gamma tube,
a spacer stamping coupled between the driver tube and the gamma tube,
an impedance matching block assembly coupled between the driver tube and the gamma tube, and
a dielectric coating.

3. A frequency modulation (FM) antenna, comprising:
a hermetically sealed driver assembly, comprising:
a driver tube,
a gamma tube,
a spacer stamping coupled between the driver tube and the gamma tube,
an impedance matching block assembly coupled between the driver tube and the gamma tube, and
an F spacer coupled to the driver tube and the impedance matching block assembly.

4. A frequency modulation (FM) antenna, comprising:
a hermetically sealed driver assembly, comprising:
a driver tube,
a gamma tube,
a spacer stamping coupled between the driver tube and the gamma tube,
an impedance matching block assembly coupled between the driver tube and the gamma tube, and
an F connector coupled to the impedance matching block assembly.

5. A frequency modulation (FM) antenna, comprising:
a hermetically sealed driver assembly, comprising:
a driver tube,
a gamma tube,
a spacer stamping coupled between the driver tube and the gamma tube, and
an impedance matching block assembly coupled between the driver tube and the gamma tube, wherein the impedance matching block assembly comprises:
a matching block case;
a printed circuit board residing within the matching block case;

a capacitor coupled to the printed circuit board;

a nut connector coupled to the printed circuit board and the gamma tube; and a printed circuit board thread coupled to the printed circuit board and an F connector.

6. A frequency modulation (FM), antenna comprising:

a hermetically sealed driver assembly, comprising:

a driver tube, a gamma tube, a spacer stamping coupled between the driver tube and the gamma tube, and an impedance matching block assembly coupled between the driver tube and the gamma tube;

a mounting block assembly coupled to the driver assembly;

a pole coupled to the mounting block assembly; and a transmission line coupled to the driver assembly.

7. The antenna of claim 6, wherein the mounting block assembly comprises:

a mounting block, wherein a first side of the mounting block is coupled to the driver assembly;

a cleat coupled to a second side of the mounting block; and a U-bolt, wherein the U-bolt couples the cleat and the mounting block to the pole.

8. The antenna of claim 7, wherein the mounting block comprises:

a first recess on the first side of the mounting block, wherein the driver tube resides within the first recess;

a second recess on the first side of the mounting block, wherein the impedance matching block assembly resides within the second recess; and a third recess on the second side of the mounting block, wherein the cleat resides within the third recess.

9. The antenna of claim 7, wherein the cleat comprises:

a plurality of teeth for engaging the pole.

10. The antenna of claim 7, wherein the U-bolt comprises:

a plurality of serrations for engaging the pole.

11. A frequency modulation (FM) antenna, comprising:

a driver assembly, comprising:

a driver tube, a gamma tube, a spacer stamping coupled between the driver tube and the gamma tube, and an impedance matching block assembly coupled between the driver tube and the gamma tube;

a mounting block assembly coupled to the driver assembly, wherein the mounting block assembly comprises:

a mounting block, wherein a first side of the mounting block is coupled to the driver assembly, a cleat coupled to a second side of the mounting block, and a U-bolt, wherein the U-bolt couples the cleat and the mounting block to a pole;

the pole coupled to the mounting block assembly; and a transmission line coupled to the driver assembly.

12. The antenna of claim 11, wherein the mounting block comprises:

a first recess on the first side of the mounting block, wherein the driver tube resides within the first recess;

a second recess on the first side of the mounting block, wherein the impedance matching block assembly resides within the second recess; and a third recess on the second side of the mounting block, wherein the cleat resides within the third recess.

13. The antenna of claim 11, wherein the cleat comprises:

a plurality of teeth for engaging the pole.

14. The antenna of claim 11, wherein the U-bolt comprise:

a plurality of serrations for engaging the pole.

15. The antenna of claim 11, wherein the driver assembly further comprises:

a plurality of caps coupled to ends of the driver tube and the gamma tube, wherein the plurality of caps hermetically seal the ends of the driver tube and the gamma tube;

a dielectric coating;

an F connector coupled to the impedance matching block assembly; and an F spacer coupled to the driver tube, the impedance matching block assembly, and the F connector.

16. The antenna of claim 11, wherein the impedance matching block assembly comprises:

a matching block case;

a printed circuit board residing within the matching block case;

a capacitor coupled to the printed circuit board;

a nut connector coupled to the printed circuit board and the gamma tube; and a printed circuit board thread coupled to the printed circuit board and an F connector.

17. A frequency modulation (FM) antenna, comprising:

a hermetically sealed driver assembly, comprising:

a driver tube, a gamma tube, a spacer stamping coupled between the driver tube and the gamma tube, an impedance matching block assembly coupled between the driver tube and the gamma tube, wherein the impedance matching block assembly comprises:

a matching block case, a printed circuit board residing within the matching block case, a capacitor coupled to the printed circuit board, a nut connector coupled to the printed circuit board and the gamma tube, and a printed circuit board thread coupled to the printed circuit board and an F connector, a plurality of caps coupled to ends of the driver tube and the gamma tube, wherein the plurality of caps hermetically seal the ends of the driver tube and the gamma tube, a dielectric coating, the F connector, and an F spacer coupled to the driver tube, the printed circuit board thread, and the F connector;

a mounting block assembly coupled to the driver assembly;

a pole coupled to the mounting block assembly; and a transmission line coupled to the driver assembly.

18. The antenna of claim 17, wherein the mounting block assembly comprises:

a mounting block, comprising:

a first recess on a first side of the mounting block, wherein the driver tube resides within the first recess, a second recess on the first side of the mounting block, wherein the impedance matching block assembly resides within the second recess, and a third recess on a second side of the mounting block, wherein the cleat resides within the third recess;

a cleat coupled to the second side of the mounting block, wherein the cleat comprises a plurality of teeth for engaging the pole; and a U-bolt, wherein the U-bolt couples the cleat and the mounting block to the pole, wherein the U-bolt comprises a plurality of serrations for engaging the pole.

* * * * *